US005478686A

United States Patent [19]

Kawakami et al.

[11] Patent Number: 5,478,686

[45] Date of Patent: Dec. 26, 1995

[54] FIXABLE TONER WITH A MODIFIED BISPHENOLIC POLYESTER RESIN

[75] Inventors: Hiroaki Kawakami; Yusuke Karami, both of Yokohama; Shinji Doi, Kawasaki; Satoshi Matsunaga, Tokyo; Yasuhide Goseki; Takashige Kasuya, both of Yokohama; Masuo Yamazaki, Kawasaki; Kiyoko Maeda, Yokosuka, all of Japan

[73] Assignee: Canon Kabushiki Kaisha, Tokyo, Japan

[21] Appl. No.: 37,185

[22] Filed: Mar. 25, 1993

Related U.S. Application Data

[63] Continuation of Ser. No. 593,812, Oct. 5, 1990, abandoned.

[30] Foreign Application Priority Data

| | | | |
|---|---|---|---|
| Oct. 5, 1989 | [JP] | Japan | 1-258684 |
| Nov. 14, 1989 | [JP] | Japan | 1-294036 |
| Dec. 29, 1989 | [JP] | Japan | 1-343251 |

[51] Int. Cl.[6] ..... G03G 9/083

[52] U.S. Cl. ..... 430/106.6; 430/109; 430/107; 430/137

[58] Field of Search ..... 430/110, 106.6, 430/107, 109, 137

[56] References Cited

U.S. PATENT DOCUMENTS

| | | | |
|---|---|---|---|
| 3,590,000 | 6/1971 | Palermiti et al. | 252/62.1 |
| 3,681,106 | 8/1972 | Burns et al. | 117/17.5 |
| 4,525,445 | 6/1985 | De Roo et al. . | |
| 4,533,614 | 8/1985 | Fukumoto et al. | 430/99 |
| 4,535,048 | 8/1985 | Inoue et al. | 430/110 |
| 4,810,612 | 3/1989 | Ueda et al. | 430/109 |
| 4,957,774 | 9/1990 | Doi et al. | 427/45.1 |
| 4,960,664 | 10/1990 | Yamada et al. | 430/109 |
| 4,978,596 | 12/1990 | Shimizu et al. | 430/109 |
| 4,980,448 | 12/1990 | Tajiri et al. | 430/109 |
| 4,994,340 | 2/1991 | Yamazaki et al. | 430/106.6 |
| 5,026,621 | 6/1991 | Tsubuko et al. | 430/109 |

FOREIGN PATENT DOCUMENTS

| | | | |
|---|---|---|---|
| 0104805 | 4/1984 | European Pat. Off. . | |
| 0183566 | 6/1986 | European Pat. Off. . | |
| 0195604 | 9/1986 | European Pat. Off. . | |
| 60-004947 | 1/1985 | Japan | G03G 9/08 |
| 60-067958 | 4/1985 | Japan . | |
| 62-265670 | 11/1987 | Japan . | |
| 1-015755 | 1/1989 | Japan . | |
| 2082788 | 3/1982 | United Kingdom . | |

*Primary Examiner*—Marion E. McCamish
*Assistant Examiner*—Laura Weiner
*Attorney, Agent, or Firm*—Fitzpatrick, Cella, Harper & Scinto

[57] ABSTRACT

A heat fixable toner comprises a binder resin and a release agent. The binder resin comprises a polyester resin, and the release agent comprises a graft-modified polyolefin.

33 Claims, 4 Drawing Sheets

FIXABLE TONER WITH A MODIFIED BISPHENOLIC POLYESTER RESIN

This application is a continuation of application Ser. No. 07/593,812 filed Oct. 5, 1990, now abandoned.

BACKGROUND OF THE INVENTION

1. Field of the invention

The present invention relates to a heat fixable toner used for obtaining a fixed toner image by forming a toner image using an image forming process such as electrophotography, electrostatic printing or magnetic recording, and heat-fixing the formed toner image on a recording medium. It also relates to a heat fixing method making use of such a toner.

2. Related Background Art

As a method of fixing a visible image of toner onto a recording medium, a heat-roll fixing system is widely used, in which a recording medium retaining thereon a toner visible image which has not been fixed is heated while it is held and carried between a heat roller maintained at a given temperature and a pressure roller having an elastic layer and coming into pressure contact with the heat roller.

A belt fixing system is known, as disclosed in U.S. Pat. No. 3,578,797.

The above conventional heat-roll fixing that has been hitherto widely used, however, has the following disadvantages:

(1) A time during which an image-forming operation is prohibited, i.e., what is called a waiting time, is required until the heat roller reaches the given temperature.

(2) The heat roller must be maintained at an optimum temperature in order to prevent poor fixing caused by the variations of the heat-roller temperature that may occur when the recording medium is passed or because of other external factors, and also to prevent the transfer of toner to the heat roller, i.e., what is called the offset phenomenon. This makes it necessary to make large the heat capacity of the heat roller or a heater element, which requires a large electric power.

(3) After the recording medium has been passed over the heat roller, the recording medium and the toner on the recording medium are slowly cooled because of a high temperature of the heat roller. This results in a high adhesion of the toner. Thus, conjointly with the curvature of the roller also, there may often occur offset, or paper jam caused by the rolling-up of the recording medium to the roller.

(4) A protective member must be provided on account of safety since there is a possibility of directly touching the high-temperature heat roller.

The above problems (1) and (2) in the heat-roll fixing are not fundamentally solved also in the belt fixing system disclosed in U.S. Pat. No. 3,578,797.

Japanese Patent Application Laid-open No. 63-313182, previously proposed by the present applicant, provides an image forming apparatus with a shorter waiting time and a low power consumption, comprising a fixing unit in which a toner visible image is heated through a movable heat-resistant sheet by means of a heating element having a low heat capacity, pulsewise generating heat by electrification, and is thus fixed to a recording medium. Japanese Patent Application Laid-open No. 1-187582, previously proposed by the present applicant, provides a fixing unit for heat-fixing a toner visible image to a recording medium through a heat-resistant sheet, wherein said heat-resistant sheet comprises a heat-resistant layer and a release layer or a low-resistant layer, thereby effectively preventing the offset phenomenon.

In addition to the factors in the above fixing apparatus, however, achievement of both the fixing performance of an excellent toner visible image to a recording medium and the prevention of offset and simultaneous realization of a fixing method with a shorter waiting time and a low power consumption greatly depend on the properties of a toner.

As materials suited for a low-temperature fixable toner, polyester resins with a low molecular weight have attracted notice. An attempt to use a polyester resin as a binder for a toner is seen in U.S. Pat. Nos. 3,590,000 and 3,681,106, and Japanese Pat. Publications No. 46-12680 and No. 52-25420. Since, however, melt viscosity of the resin is lowered when the molecular weight is made smaller with the aim of lower-temperature fixing, the temperature control of a fixing device is so adjusted as to yield a temperature at which a toner can be sufficiently fixed. This may cause the offset phenomenon in which the toner is melt-adhered not only to paper, but also onto a heater element.

Concerning the prevention of offset in respect of a toner comprising a polyester resin as a main binder, Japanese Patent Publication No. 52-25420 proposes a method in which a polymer is made non-linear by mixture of a polyol having three or more hydroxyl groups or a poly acid to improve its viscoelasticity so that the offset resistance at the time of fixing can be improved. However, making the polymer non-linear until the toner can have a sufficient offset resistance may result in a rise of its fixing point, and hence this method is not suitable for a toner intended to be fixed at a low temperature.

As proposed in Japanese Patent Application Laid-open No. 59-9669, it has been attempted to mix a polyvalent metal compound so as to give a cross-linked structure by virtue of metal ions, so that the polymer chains can mutually act to change melt viscoelasticity, thus preventing the offset. The polyvalent metal compound, however, has so low a specific resistance compared to resins that the static chargeability of a toner may be lowered. For this reason, if the prevention of offset relies only on the cross-linking of the polyvalent metal compound, the compound is necessarily added in a larger amount, which tends to lower the development performance of the toner. In this way, the low-temperature fixability and the offset resistance are performances that conflict with each other, and it is very difficult to combine these. As a means for solving this problem, Japanese Patent Applications Laid-open No. 60-67958 and No. 64-15755 propose a method in which a low-molecular weight polyester for achieving the low-temperature fixing and a high-molecular weight polyester for achieving the offset resistance are blended. This has made it possible to achieve the low-temperature fixing while keeping the offset resistance when compared with conventional polyesters.

However, in an attempt to achieve a better low-temperature fixing, the low-molecular weight polyester to be blended must be made to have a low melting point, resulting in a lowering of the offset resistance. When a polyester made to have a molecular weight high enough to well compensate for this lowering is mixed with the low-molecular weight polyester, it is difficult for the components added to a toner as exemplified by a coloring agent, to be uniformly dispersed and it has been impossible to obtain good development performance.

Japanese Patent Application Laid-open No. 60-4947 proposes a toner in which an organic metal compound is added to a mixture of a linear polyester and a non-linear polyester resin, which is then cross-linked. In this instance, however, both of the linear polyester and the non-linear polyester undergo cross-linking, and the non-linear polyester, in particular, is made high-molecular. Hence, there is room for further improvement when low-temperature fixing is desired.

SUMMARY OF THE INVENTION

An object of the present invention is to provide a heat fixable toner that has solved the above problems.

Another object of the present invention is to provide a toner that can be well fixed at a low temperature, can save energy, can prevent offset and also can promise a broad region of fixability.

Still another object of the present invention is to provide a toner that causes no blocking when it is stored and also when it is used.

A further object of the present invention is to provide a toner that causes no melt-adhesion onto a toner carrying member or a photosensitive member when used in various states in any environment.

A still further object of the present invention is to provide a toner having superior development performance, capable of obtaining an image quality that has a sufficiently high image density, is rich in sharpness and resolution and is free from ground fog.

A still further object of the present invention is to provide a toner that can be readily produced, has a good production efficiency, can be stably produced and enjoys a low cost.

A still further object of the present invention is to provide a toner used for a novel heat-fixing method that requires substantially no, or only a very short, waiting time and also a low power consumption, can prevent the offset phenomenon from occurring and also can achieve good fixing of a toner image to a recording medium, and a fixing method making use of such a toner.

A still further object of the present invention is to provide a heat fixing method that employs no high-temperature revolving roller, thus requiring no heat-resistant special bearing.

A still further object of the present invention is to provide a heat fixing method using a fixing device so constituted as to prevent direct touch to high-temperature parts, thus achieving higher safety or requiring no protective members.

To achieve the above objects, the present invention provides a heat fixable toner comprising a binder resin and a release agent, wherein said binder resin comprises a polyester resin and said release agent comprises a graft-modified polyolefin.

The present invention also provides a heat fixing method comprising heat-fixing a toner image formed on a recording medium, to said recording medium by means of a heater element stationarily supported and a pressure member that is opposed to and in pressure contact with said heater element and brings said recording medium into close contact with said heater element through a film interposed between them, wherein said toner comprises a binder resin and a release agent; said binder resin comprising a polyester resin and said release agent comprising a graft-modified polyolefin.

DESCRIPTION OF THE PREFERRED EMBODIMENTS

The toner of the present invention contains at least a polyester resin as a binder resin and a graft-modified polyolefin as a release agent.

Preferred examples of the polyester resin used in the present invention will be described below.

The polyester resin includes, for example, a polyester resin obtained by co-condensation polymerization of an etherified bisphenol with a carboxylic acid or its derivative, including a carboxylic acid with two or more carboxylic groups, an anhydride thereof or a lower alkyl ester thereof. This polyester resin may preferably have the properties that the melt viscosity $\eta'$ measured with an overhead-type flow tester is from $10^3$ to $10^6$ poise at a temperature within the temperature range of from 80° C. to 120° C., and an absolute value of the inclination of a graph is not more than 0.50 ln (poise)/°C. when the natural logarithms $\ln\eta'$ of the melt viscosity at 80° C. and 120° C. are plotted with respect to the temperatures.

Figure 1:
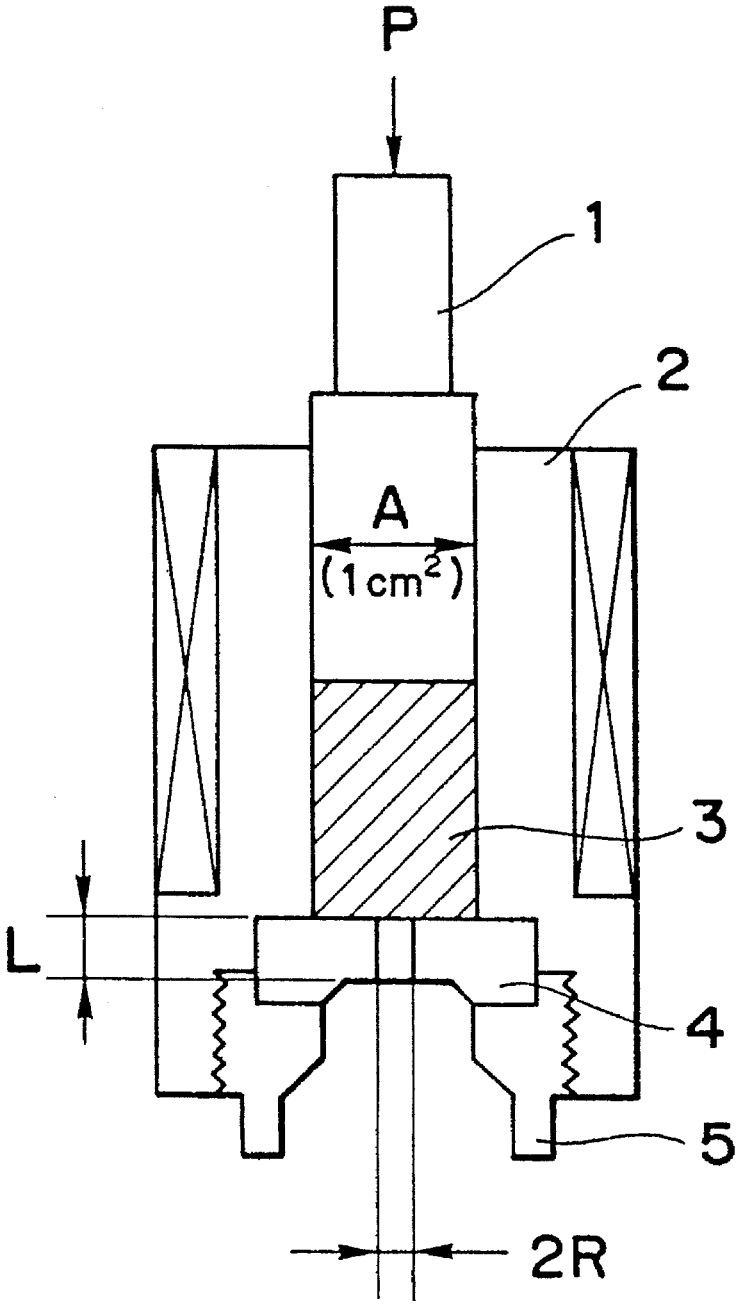
FIG. 1 is a schematic cross section of an overhead-type flow tester used for measuring the melt viscosity of toner or binder resin.

In the present invention, the viscosity can be measured using an overhead-type flow tester as illustrated in FIG. 1 (Shimadzu Flow Tester CFT-500 Type). In the first place, about 1.5 g of a sample 3 molded using a pressure molder is extruded from a nozzle 4 of 1 mm in diameter and 1 mm in length under application of a load of 10 kgf at a given temperature using a plunger 1, and thus the quantity of the fall of the plunger (the rate of flow-out) of the flow tester is measured. This rate of flow-out is measured at each temperature (at intervals of 5° C. within the temperature range of from 80° C. to 150° C.). The apparent viscosity $\eta'$ can be calculated from the resulting values, based on the following equation.

$$\eta' = \frac{TW'}{DW'} = \frac{\pi P R^4}{8LQ} \text{ (poise)}$$

wherein;

$$TW' = \frac{PR}{2L} \text{ (dyne/cm}^2\text{)}$$

$$DW' = \frac{2Q}{\pi R^3} \text{ (sec}^{-1}\text{)}$$

$\eta'$: Apparent viscosity (poise)

TW': Apparent slide reaction on tube wall (dyne/cm$^2$)

DW': Apparent slide speed on tube wall (1/sec)

Q: Rate of flow-out (cm$^3$/sec=ml/sec)

P: Extrusion pressure (dyne/cm$^2$) [10 kgf=980×10$^4$ dyne]

R: Radius of nozzle (cm)

L: Length of nozzle (cm)

A melt viscosity more than $10^6$ poise at 80° C. to 150° C., of the binder resin polyester used for the toner may result in an increase in power consumption even in the heat-fixing method of the present invention, bringing about difficulty in quick start.

On the other hand, a melt viscosity less than $10^3$ poise at 80° C. to 150° C. may make conspicuous the problems of bleed-through in transfer paper caused by the excessive fusion of toner and bleeding of image due to strike-through or spread of the fused toner.

The absolute value of the inclination of the natural logarithms $\ln\eta'$ of the melt viscosity $\eta'$ in the temperature range of from 80° C. to 150° C., with respect to the temperatures, reflects the sensitiveness of the viscosity of the polyester resin of the present invention to the temperature variations. A value more than 0.50 ln (poise)/°C. tends to cause the offset to the recording medium such as a film An alcohol component which is a component material of the polyester resin according to the present invention may preferably include etherified bisphenols, which contribute the retention of impact resistance and abrasion resistance required as a toner and may not adversely affect the electrophotographic performances other than the fixing performance.

Figure 2:
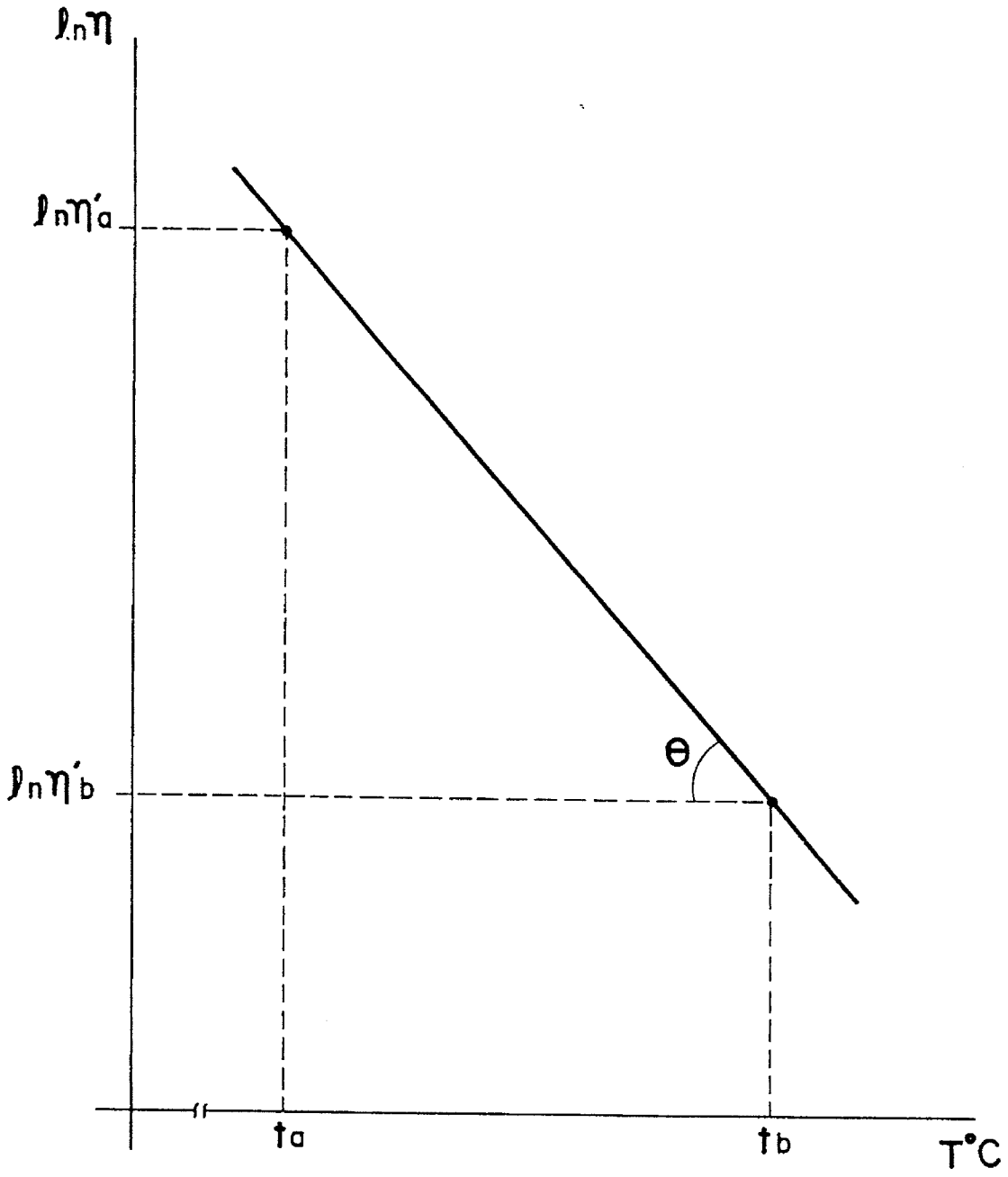
FIG. 2 is a graphic representation concerning the inclination of the natural logarithms $\ln\eta$ of the viscosity of toner or binder resin, with respect to temperature.

In the present invention, the "inclination" of the viscosity is a value obtained when, as FIG. 2 shows, a measuring point at $t_a$°C. and a measuring point at tb°C. in the graph are connected by a straight line and the "inclination" is calculated from the equation:

$$\tan\theta = \frac{\ln\theta a' - \ln\eta b'}{t_b - t_a}$$

This is used in approximation as the "inclination" of a slope, wherein the $\ln\eta a'$ represents a value corresponding to the natural logarithm of the viscosity at $t_a$°C., and $\ln\eta b'$ represents a value at $t_b$°C.

Those which can be used as the etherified diphenols, i.e., the materials of the polyester resin serving as the binder resin used in the toner of the present invention, are exemplified by polyoxystyrene (6)-2,2-bis(4-hydroxyphenyl)propane, polyhydroxybutylene (2)-2,2-bis(4-hydroxyphenyl) propane, polyoxyethylene (3)-2,2-bis(4-hydroxyphenyl)propane, polyoxypropylene (3)-bis(4-hydroxyphenyl)thioether, polyoxyethylene (2)-2,6-dichloro-4-hydroxyphenyl, 2',3',6'-trichloro-4'-hydroxyphenylmethane, polyoxypropylene (3)-2-bromo-4-hydroxyphenyl, 4-hydroxyphenyl ether, polyoxyethylene (2,5)-p,p-bisphenol, polyoxybutylene (4)-bis(4-hydroxyphenyl)ketone, polyoxystyrene (7)-bis(4-hydroxyphenyl)ether, polyoxypentylene (3)-2,2-bis(2,6-diodo-4-hydroxyphenyl)propane, and polyoxypropylene (2,2)-2,2-bis(4-hydroxyphenyl)propane.

A group of the etherified diphenols includes etherified bisphenols. A preferred group of the etherified bisphenols includes those formed into ethoxy or propoxy, which may have 2 or 3 mols of oxyethylene or oxypropylene per mol of bisphenol and may have a propylene or sulfone group as a substituent. Examples of this group are polyoxyethylene (2,5)-bis(2,6-dibromo-4-hydroxyphenyl)sulfone, polyoxypropylene (3)-2,2bis(2,6-difluoro-4-hydroxyphenyl)propane, and polyoxyethylene (1,5)-polyoxypropylene (1,0)-bis(4-hydroxyphenyl)sulfone.

Other preferred examples of the etherified bisphenols are polyoxypropylene-2,2'-bis(4-hydroxyphenyl)propane, and polyoxyethylene- or polyoxypropylene-2,2-bis(4-hydroxy-2,6-dichlorophenyl)propane (the number of the oxyalkylene unit is 2.1 to 2.5 per mol of bisphenol).

The carboxylic acids with two or more carboxylic groups, which are component materials of the polyester resin according to the present invention, include aromatic carboxylic acids and other carboxylic acids, either of which can be used. Not less than 95 mol % of the acid component may preferably be held by dicarboxylic acids. It is possible to use aromatic dicarboxylic acids as exemplified by terephthalic acid, isophthalic acid, phthalic acid, diphenyl-p,p'-dicarboxylic acid, naphthalene-2,7-dicarboxylic acid, naphthalene-2,6-dicarboxylic acid, diphenylmethane-p,p'-dicarboxylic acid, benzophenone-4,4'-dicarboxylic acid, and 1,2-diphenoxyethane-p,p'-dicarboxylic acid. Acids other than these include maleic acid, fumaric acid, glutaric acid, cyclohexanecarboxylic acid, succinic acid, malonic acid, adipic acid, mesaconic acid, citraconic acid, sebacic acid, anhydrides of these acids, and lower-alkyl esterified compounds of these acids.

The polycarboxylic acids with three or more carboxylic groups can also be used. They are exemplified by trimellitic acid, pyromellitic acid, cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methylenecarboxylpropane, 1,3-dicarboxyl-2-methyl-2-methylenecarboxylpropane, tetra(methylenecarboxyl) methane, 1,2,7,8-octanetetracarboxylic acid, and anhydrides of these. Lower-alkyl esterified compounds of these may also be used in a small amount. Polyols having three or more hydroxyl groups may also be used if it is in a small amount. They include sorbitol, 1,2,3,6-hexanetetrol, 1,4-sorbitan, pentaerythritol, dipentaerythritol, tripentaerythritol, sucrose, 1,2,4-mesitatriol, glycerol, 2-methylpropanetriol, 2-methyl-1,2,4-butanetriol, trimethylolethane, trimethylolpropane, 1,3,5-trihydroxymethylbenzene, erythro-1,2,3-butanetriol, and threo-1,2,3-butanetriol.

Other preferred polyester resins include polyester resins with an acid value of from 5 to 60, comprised of;

(A) an etherified bisphenol;

(B) not less than 30 mol % of an aromatic dicarboxylic acid, in all acid components;

(C) 5 to 40% by weight of an alkenyl-substituted dicarboxylic acid and/or an alkyl-substituted dicarboxylic acid, based on the total amount of acids; and (D) a polycarboxylic acid with three or more carboxylic groups and/or a polyol with three or more hydroxyl groups.

In the present invention, the toner can be preferably heat-fixed to the recording medium at a lower power consumption when a toner is used which contains at least i) a polyester resin with an acid value of from 5 to 60, comprising the etherified diphenols and the aromatic dicarboxylic acids as basic skeletons, where the polymer skeletons are made to have network structures by the polycarboxylic acids with three or more carboxylic groups and/or polyols with three or more hydroxyl groups, and the alkenyl-substituted dicarboxylic acids and/or alkyl-substituted dicarboxylic acids are introduced as soft segments and ii) an organic metal compound containing a metal having a valence of two or more, used in an amount of from 0.2 to 6% by weight based on the resin.

An amount of the above soft segments which is less than 5% by weight based on the total amount of acids tends to result in an increase in the power consumption required for the heat fixing. On the other hand, an amount exceeding 40% by weight tends to make stronger the agglomeration force between toner particles to lower storage stability. The polycarboxylic acids, the component by which the polymer skeletons are made to have network structures, may preferably be contained in the polyester in an amount of from 5 to 30% by weight. The polyols may preferably be contained in an amount of not more than 5% by weight.

The total amount of the polycarboxylic acids and polyols may preferably be not more than 40% by weight. An amount more than 40% by weight may result in a lowering of the moisture resistance of the toner and make charge characteristics unstable because of environmental variations, bringing about defects at the time of the image formation (at the time of development or transfer) before the fixing. It may further result in an increase in the cost for the pulverization in the step of preparing the toner, and also requires, as a matter of course, a larger energy for achieving the heat fixing of the toner.

On the other hand, the total amount of the polycarboxylic acids may preferably be not less than 10% by weight in the polyester. An amount less than that may make the tendency of excessive fusion of toner begin to appear in the step of heat fixing. An amount less than 5% by weight tends to cause the penetration into the recording medium such as transferring paper, the bleed-through, or the bleeding of image because of the spread of fused toner.

Taking account of electrophotographic performances such as charge characteristics, durability and transfer performance which are required for the toner, among the main components of the polyester, it is preferred for the aromatic dicarboxylic acids as the acid component to comprise not less than 30 mol % and more preferably not less than 40 mol % in all the acid components, and for the etherified diphenols as the alcohol component to comprise not less than 80 mol % and more preferably not less than 90 mol % in all the alcohol components.

The above polyester resins may be used as a binder resin, and an organic metal compound containing a metal of a valence of two or more may be added in a small amount in the step of heat-kneading at the time the toner is prepared, so that in the heat fixing method of the present invention the excessive fusion of toner, in particular, can be effectively prevented and the problems such as the penetration into the recording medium, the bleed-through and the bleeding of image because of the spread of fused toner can be more effectively prevented from occurring.

According to the studies made by the present inventors, a "weak cross-linked structure", different from the one attributable to the network-structure forming component in the component materials of the polyester resin, can be brought in the toner by a metal ion, so that there can be a very little increase in the consumption of the power required for the fixing. However, the above effect obtained by the present invention, attributable to the organic metal compound containing a metal of a valence of two or more, can be attained when the polyester resin contains the aromatic components in a large amount. When the polyester resin has an acid value of from 5 to 60, the metal compound can be added in a smaller amount, thus resulting in no concurrence of the problems such as an increase in power consumption and a lowering of moisture resistance of the toner.

Accordingly, the metal compound in the present invention may be added in an amount of from 0.2 to 6% by weight, and more preferably from 1 to 5% by weight, based on the polyester resin. An amount less than 0.2% by weight may bring about no substantial effect, and an amount more than 6% by weight may cause an increase in the power consumption at the time of the fixing because of an increase in the heat capacity of the toner itself, like the case when an inorganic filler is added in a large amount. This may considerably lessen the static chargeability of the toner because of the incorporation of the metal compound having a lower specific resistance than that of the polymer, tending to result in a lowering of development performance. A lowering of moisture resistance similarly tends to occur.

In the present invention, it is preferred that the above specific polyester resin is used as a main binder resin and the toner containing the metal compound have the properties that the melt viscosity $\eta'$ measured with an overhead-type flow tester is from $10^3$ to $10^6$ poise at a temperature within the temperature range of from 120° C. to 150° C. and an absolute value of the inclination of a graph is not more than 0.50 ln (poise)/°C. when the natural logarithms $\ln\eta'$ of the melt viscosity at 120° C. and 150° C. are plotted with respect to the temperatures. This enables fixing of toner to a recording medium at a low power consumption without causing its offset to a film.

If the total amount of of the network-structure forming components in the polyester of the present invention is 35% by weight or more, or the organic metal compound containing a metal of a valence of two or more, contained in the toner, is added in an amount of 10% by weight or more based on the resin, the melt viscosity of the toner may often exceed $10^5$ poise even at 150° C.

On the other hand, a melt viscosity less than $10^3$ poise at 120° C. to 150° C. may make conspicuous the disadvantages (such as bleed-through, and bleeding of image) caused by the excessive fusion of toner.

If the total amount of the network-structure forming components in the polyester of the present invention becomes less than 5% by weight, or the organic metal compound containing a metal of a valence of two or more, contained in the toner, is added in an amount of 0.2% by weight or more based on the resin, the melt viscosity may sometimes become less than $10^3$ poise even at 120° C.

The absolute value of the inclination of the natural logarithms $\ln\eta'$ of the melt viscosity $\eta'$ at 120° C. and 150° C. of the toner of the present invention, with respect to the temperatures, reflects the sensitiveness of the viscosity of the polyester resin of the present invention to the temperature variations. An absolute value more than 0.50 ln (poise)/°C. of this inclination tends to cause the offset to the film, moreover bringing about an excessive gloss of fixed images to lower the image quality level.

This inclination also depends on the amount of the network-structure forming components and amount of the soft segments in the polyester resin of the present invention, and also the amount of the organic metal compound containing a metal of a valence of two or more, added in the toner of the present invention. It also depends on the proportion of these. Use of these in the amounts within the range of what is claimed in the present invention can achieve the fixing performance, offset resistance, and image forming performance in a good state in the heat-fixing method of the present invention.

The etherified diphenol and the aromatic dicarboxylic acid include those as previously described.

The alkenyl-substituted dicarboxylic acid or alkyl-substituted dicarboxylic acid includes maleic acid, fumaric acid, adipic acid, succinic acid, glutaric acid, sebacic acid or azelaic acid substituted with an alkenyl group or alkyl group having 6 to 18 carbon atoms, and anhydrides or esters thereof. Particularly preferred are n-dodecenyl succinate, isododecenyl succinate, n-dodecyl succinate, isododecyl succinate, isooctyl succinate, n-octyl succinate, and n-butyl succinate.

The polycarboxylic acid with three or more carboxylic groups and polyols with three or more hydroxyl groups include those as previously described.

The organic metal compound used in combination with the polyester resin includes organic salts or complexes containing the metal of a valence of two or more. Effective metal species include polyvalent metals such as Al , Ba, Ca, Cd, Co, Cr, Cu, Fe, Hg, Mg, Mn, Ni, Pb, Sn, Sr and Zn. The organic metal compound effectively includes carboxylates, alkoxylates, organic metal complexes or chelate compounds of the above metals. Examples thereof may preferably include zinc acetate, magnesium acetate, calcium acetate, aluminum acetate, magnesium stearate, calcium stearate, aluminum stearate, aluminum isopropoxide, aluminum acetylacetate, iron(II) acetylacetonate, and chromium 3,5-ditertiarybutyl stearate. In particular, acetylacetone metal complexes, or salicylic acid metal salts are preferred.

Other preferred polyester resin composition also includes a mixture containing a linear polyester resin having an acid value of less than 5 mg.KOH/g and a non-linear polyester resin having an acid value of from 5 to 60 mg.KOH/g, and also containing an organic metal compound of a valence of two or more in an amount of from 0.2 to 10 parts by weight based on 100 parts by weight of the polyester resin or the binder resin.

In the present invention, at the time when the linear polyester resin and the non-linear polyester resin are mixed, or after they have been mixed, an additive in toner particles, such as a coloring agent, and the organic metal compound comprising a metal of a valence of two or more are mixed, and metal cross-linking is carried out.

In order to achieve the low-temperature fixing, the acid value of the linear polyester resin must be less than 5 mg.KOH/g. An acid value not less than 5 mg.KOH/g may cause metal cross-linking, resulting in a high molecular weight of the linear polyester resin. This makes it difficult to effectively lower the fixing point. In order to retain the offset resistance, the acid value of the non-linear polyester resin must be 5 to 60 mg.KOH/g. An acid value less than 5 mg.KOH/g makes the metal cross-linking insufficient, and makes it impossible to obtain a satisfactory offset resistance. An acid value more than 60 mg.KOH/g may result in an excessive progress of non-linearization, often making it difficult to carry out the low-temperature fixing or often making moisture resistance poor because of an unreacted acid.

The non-linear polyester resin after mixing is further non-linearized by the metal cross-linking, and hence it is unnecessary for the non-linear polyester resin before mixing to be cross-linked to have a sufficient offset resistance. Thus, in the mixture comprising the non-linear polyester resin not cross-linked to have a sufficient offset resistance and the linear polyester resin, it is possible for the additive such as a coloring agent to be uniformely mixed and dispersed.

The linear polyester resin and the non-linear polyester resin may preferably be mixed to form a solution or mixed at the time of kneading. The acid value can be measured according to JIS K-0070.

In a more preferred embodiment, a toner comprised of at least one low-melting graft-modified polyolefin release agent having a number average molecular weight (Mn) of not more than $1.0\times10^3$, and preferably from 400 to 700, a weight average molecular weight (Mw) of not more than $2.5\times10^3$, and preferably from 700 to 1,500, an Mw/Mn of not more than 3.0, and preferably not more than 2.0, and a melting point of from 60° to 120° C., and preferably from 60° to 100° C., is used in the above binder resin. This makes it possible to carry out the heat fixing of a toner to a recording medium at a lower power consumption and lower temperature without causing offset.

Intensive studies made by the present inventors have revealed that what is required is a release agent which renders release properties at a lower temperature with respect to the low-temperature melting, linear polyester resin which enables the low-temperature fixing, that the temperature at which the release agent renders release properties correlates with the melting point of the release agent, and that a release agent having a lower melting point is more advantageous for the low-temperature fixing. When, however, a release agent with a low melting point is used, the release agent makes poor the blocking resistance of a toner and has an undesired influence of carrier filming when the product is used as a two-component type developer. Now, at least one release agent is made to have a number average molecular weight (Mn) of not more than $1.0\times10^3$, a weight average molecular weight (Mw) of not more than $2.5\times10^3$ and an Mw/Mn of not more than 3.0, which are relatively sharp. As a result, it has been made clear that the blocking resistance can thereby be improved, the release agent renders release properties at a lower temperature, and the good performance without causing the offset phenomenon can be obtained.

The low-temperature fixing can be achieved to a certain extent when the low-melting temperature release agent as described above is used in combination. It, however, has been found that the above problems can be eliminated and a good development performance and further low-temperature fixing performance can be achieved when the low-melting polyolefin release agent is graft-modified in order to further improve the dispersion of the release agent in the mixed resin of the linear polyester resin and non-linear polyester resin.

In the present invention, the molecular weight distribution of the low-melting graft modified polyolefin release agent can be measured by GPC (gel permeation chromatography) under the following conditions. Condition for measurement by GPC:

Apparatus: LC-GPC, 150 C (Waters Co.)

Column: GMH6 (Toyo Soda Manufacturing Co., Ltd.), 60 cm

Column temperature: 140° C.

Solvent: o-dichlorobenzene

Under the above measuring conditions, the molecular weight distribution possessed by a sample is calculated from the relation between a logarithmic value of a calibration curve prepared using a polyethylene standard sample and the number of count.

In the present invention, the melting point of the above release agent is measured using a differential scanning calorimeter DSC-7 (manufactured by Perkin-Elmer Co.) to determine an endothermic peak in the DSC, which peak is regarded as a maximum melting peak value.

The linear polyester resin used in the present invention can be produced by condensation polymerization of a bifunctional carboxylic acid with a diol according to a conventional method.

The bifunctional carboxylic acid refers to a dibasic carboxylic acid, an anhydride and an ester of the dibasic carboxylic acid, and a derivative thereof, including, for example, terephthalic acid, isophthalic acid, phthalic acid, diphenyl-p,p'-dicarboxylic acid, naphthalene-2,7-dicarboxylic acid, naphthalene-2,6-dicarboxylic acid, diphenylmethane-p,p'-dicarboxylic acid, benzophenone-4,4'-dicarboxylic acid, 1,2-diphenoxyethane-p,p'-dicarboxylic acid, maleic acid, fumaric acid, glutalic acid, cyclohexanecarboxylic acid, succinic acid, malonic acid and adipic acid, or anhydrides or esterified compounds of these.

The diol component includes alkylene glycols such as ethylene glycol, diethylene glycol, triethylene glycol, 1,2-propylene glycol, 1,3-propylene glycol, 1,4-butanediol, cyclohexanedimethanol, neopentyl glycol and 1,4-butenediol, bisphenol A, hydrogenated bisphenol A, polyoxypropylene (2,0)-2,2-bis(4-hydroxyphenyl) propane, polyoxyethylene (2,0)-2,2-bis(4-hydroxyphenyl)propane, 2,2'-(1,4-phenylenebisoxy) bisethanol, 1,1'-dimethyl-2,2'-(1,4-phenylenebisoxy) bisethanol, and 1,1,1',1'-tetramethyl-2,2'-(1,4-phenylenebisoxy)bisethanol.

The non-linear polyester resin used in the present invention can be produced by condensation polymerization between at least one of a polycarboxylic acid with three or more carboxylic groups and a polyol with three or more hydroxyl groups, a bifunctional carboxylic acid and a diol according to a conventional method.

As the polycarboxylic acid with three or more carboxylic groups and polyol with three or more hydroxyl groups, those previously described can be used. The bifunctional carboxylic acids and diols used in the non-linear polyester resin may be the same as used in the linear polyester resin described above.

As the organic metal compound used in combination with the polyester resin composition, those previously described can be used.

One of the features in the constitution of the heat fixable toner of the present invention is that the toner contains a releasable component (or the release agent). The above graft-modified polyolefin which is the releasable component includes unsaturated fatty acids, styrene derivatives, and polyolefin waxes graft-modified with unsaturated fatty acid esters.

The releasable component may preferably be a polyolefin graft-modified with an aromatic vinyl monomer with an unsaturated fatty acid or unsaturated fatty acid ester. The releasable component may more preferably have a melt viscosity of 1 to 250 cps (centipoise) at 160° C. and be contained in an amount of from 0.1 to 20% by weight based on the total weight of the binder resin.

The above polyolefin includes homopolymers of α-olefins such as ethylene, propylene, 1-butane, 1-hexene, 1-decene, and 4-methyl-1-pentene. It also includes copolymers of two or more kinds of α-olefins. It further includes oxides of polyolefins.

The unsaturated fatty acid or/and unsaturated fatty acid ester used for synthesizing the graft-modified polyolefin includes methacrylic acid and methacrylates such as methyl methacrylate, ethyl methacrylate, propyl methacrylate, n-butyl methacrylate, isobutyl methacrylate, n-octyl methacrylate, 2-ethylhexyl methacrylate, lauryl methacrylate, stearyl methacrylate, dodecyl methacrylate, phenyl methacrylate, dimethylaminoethyl methacrylate, diethylaminoethyl methacrylate, 2-hydroxyethyl methacrylate, 2,2,2-trifluoroethyl methacrylate, and glycidyl methacrylate; acrylic acid and acrylates such as methyl acrylate, ethyl acrylate, propyl acrylate, n-butyl acrylate, isobutyl acrylate, n-octyl acrylate, lauryl acrylate, stearyl acrylate, dodecyl acrylate, 2-ethylhexyl acrylate, phenyl acrylate, 2-chloroethyl acrylate, 2-hydroxyethyl acrylate, cyclohexyl acrylate, dimethylaminoethyl acrylate, diethylaminoethyl acrylate, dibutylaminoethyl acrylate, 2-ethoxy acrylate, and 1,4-butanediol diacrylate; maleic acid, fumaric acid, itaconic acid, citraconic acid, and unsaturated dibasic acid esters such as monoethyl maleate, diethyl maleate, monopropyl maleate, dipropyl maleate, monobutyl maleate, dibutyl maleate, di-2-ethylhexyl maleate, monoethyl fumarate, diethyl fumarate, dibutyl fumarate, di-2-ethylhexyl fumarate, monoethyl itaconate, diethyl itaconate, monoethyl citraconate, and diethyl citraconate. These can be used alone or in combination of two or more kinds.

The aromatic vinyl monomer includes styrene, o-methylstyrene, m-methylstyrene, p-methylstyrene, α-methylstyrene, 2,4-dimethylstyrene, p-ethylstyrene, p-n-butylstyrene, p-tert-butylstyrene, p-n-dodecylstyrene, p-phenylstyrene, and p-chlorostyrene. These can be used alone or in combination of two or more kinds.

The polyolefin can be graft-modified using conventionally known methods. For example, the polyolefin, the aromatic vinyl monomer and the unsaturated fatty acid or unsaturated fatty acid ester which are in the state of a solution or in a molten state may be reacted by heating in the atmosphere, optionally under application of pressure, and in the presence of a radical initiator. A graft-modified polyolefin can be thus obtained. The grafting using the aromatic vinyl monomer and the unsaturated fatty acid or unsaturated fatty acid ester may be carried out using both at the same time or may be carried out using them separately.

The initiator used in the grafting reaction includes, for example, benzoyl peroxide, dichlorobenzoyl peroxide, di-tert-butyl peroxide, lauroyl peroxide, tert-butyl perphenyl acetate, cumine pivarate, azobisisobutylonitrile, dimethylazoisobutyrate, and dicumyl peroxide.

As to the proportion of the grafting agent to the polyolefin, the former may preferably be in an amount of from 0.1 to 100 parts by weight, and more preferably from 1 to 50 parts by weight, based on 100 parts by weight of the latter. An amount less than 0.1 part by weight can bring about little effect of grafting, and an amount more than 100 parts by weight tends to result in loss of advantageous properties inherent in the polyolefin.

The aromatic vinyl monomer and the unsaturated fatty acid or unsaturated fatty acid ester may be used in a weight ratio of from 95:5 to 5:95, and more preferably from 80:20 to 20:80. An excessive amount for the unsaturated fatty acid or unsaturated fatty acid ester tends to result in a decrease in the releasing effect inherent in the polyolefin. An excessive amount for the aromatic vinyl monomer can not so much bring about an improvement in the dispersibility of the polyolefin in the toner.

The graft-modified polyolefin used in the present invention may preferably be added in an amount of from 0.1 to 20 parts by weight, and more preferably from 0.5 to 10 parts by weight, based on 100 parts by weight of the binder resin. An amount less than 0.1 part by weight can not bring about a sufficient releasing effect, and an amount more than 20 parts by weight tends to result in a lowering of the blocking resistance of the toner.

The graft-modified polyolefin used in the present invention may preferably have a melt viscosity of 1 to 250 cps (centipoise) at 160° C. A melt viscosity less than 1 cps tends to cause the blocking of toner. A melt viscosity more than 250 cps makes it hard for the modified polyolefin to bleed from the toner and makes it hard for the releasing effect to be exhibited. In the fixing method of the present invention, it is preferred that in general a releasable component having a lower melt viscosity is used when a lower fixing temperature is selected.

The melt viscosity referred to in the present invention is based on a value measured with a Brookfield type viscometer.

In the toner of the present invention, in the instance where i) the polyester resin obtained by co-condensation polymerization of the etherified bisphenol with the carboxylic acid comprised of a carboxylic acid with two or more carboxylic groups, an anhydride thereof or a lower-alkyl ester thereof and the release agent are contained, ii) the polyester resin has the properties that the melt viscosity η' measured with an overhead-type flow tester is from $10^3$ to $10^6$ poise at a temperature within the temperature range of from 80° C. to 120° C. and an absolute value of the inclination of a graph is not more than 0.50 ln (poise)/°C. when the natural logarithms lnη of the melt viscosity at 80° C. and 120° C. are plotted with respect to the temperatures and also iii) the release agent is the polyolefin graft-modified with an aromatic vinyl monomer and an unsaturated fatty acid or unsaturated fatty acid ester, having a melt viscosity of 1 to 250 cps (centipoise) at 160° C., and is contained in an amount of from 0.1 to 20% by weight based on the total weight of the binder resin;

Other resins may also be contained in the toner in addition to the polyester resin comprised of the above component materials, in an amount less than (preferably in an amount of not more than 30% by weight of) the polyester resin and so as for the melt viscosity η' measured by an overhead-type flow tester not to deviate from a value outside the range of from $10^3$ to $10^6$ poise at a temperature within the temperature range of from 80° C. to 120° C., and for the absolute value of the inclination of a graph not to become more than 0.50 ln (poise)/°C. when the natural logarithms lnη' of the melt viscosity at 80° C. and 120° C. are plotted with respect to the temperatures. Such resins include vinyl resins mainly composed of styrene, styrene-butadiene resins, silicone resins, polyurethane resins, polyamide resins, epoxy resins, polyvinyl butyral resins, rosin, modified rosins, terpene resins, phenol resins, aliphatic or alicyclic hydrocarbon resins, aromatic petroleum resins, chlorinated paraffin, and paraffin wax.

In the toner according to another embodiment of the present invention, in the instance where i) the polyester resin having an acid value of from 5 to 60 comprised of at least;

(A) an etherified bisphenol;

(B) not less than 30 mol % of an aromatic dicarboxylic acid, in all acid components;

(C) 5 to 40% by weight of an alkenyl-substituted dicarboxylic acid and/or an alkyl-substituted dicarboxylic acid, based on the total amount of acids; and (D) a polycarboxylic acid with three or more carboxylic groups and/or polyols with three or more hydroxyl groups;

and the organic metal compound containing a metal having a valence of two or more, used in an amount of from 0.2 to 6% by weight based on the resin are contained, ii) the coloring component and the releasable component are also contained, iii) the melt viscosity η' as a toner, measured by an overhead-type flow tester is from $10^3$ to $10^6$ poise at a temperature within the temperature range of from 120° C. to 150° C. and an absolute value of the inclination of a graph is not more than 0.50 ln (poise)/°C. when the natural logarithms lnη' of the melt viscosity at 120° C. and 150° C. are plotted with respect to the temperatures, and also iv) the releasable component is the polyolefin graft-modified with an aromatic vinyl monomer and an unsaturated fatty acid or unsaturated fatty acid ester, having a melt viscosity of 1 to 250 cps (centipoise) at 160° C., and is contained in an amount of from 0.1 to 20% by weight based on the total weight of the binder resin;

Other resins may also be contained in addition to the polyester resin in an amount less than the amount of polyester resin and so as for the melt viscosity η' measured by an overhead-type flow tester not to become outside the range of from $10^3$ to $10^6$ poise at a temperature within the temperature range of from 120° C. to 150° C., and for the absolute value of the inclination of a graph not to become more than 0.50 ln (poise)/°C. when the natural logarithms lnη' of the melt viscosity at 120° C. and 150° C. are plotted with respect to the temperatures. Such resins include, for example, vinyl resins mainly composed of styrene, styrene-butadiene resins, silicone resins, polyurethane resins, polyamide resins, epoxy resins, polyvinyl butyral resins, rosin, modified rosins, terpene resins, phenol resins, aliphatic or alicyclic hydrocarbon resins, aromatic petroleum resins, chlorinated paraffin, and paraffin wax.

In instances in which the toner is used as a magnetic toner containing magnetic fine particles, a material that exhibits magnetism or can be magnetized is used as the magnetic fine particles. Such a material includes, for example, metals such as iron, manganese, nickel, cobalt, and chromium; magnetite, hematite, all sorts of ferrites, manganese alloys, and other ferromagnetic alloys. These materials can be used in the form of fine powder having an average particle diameter of from 0.05 to 5 μm. The magnetic fine particles may be contained in the magnetic toner preferably in an amount of from 15 to 70% by weight, and more preferably from 25 to 45% by weight, based on the total weight of the magnetic toner.

In the toner used in the present invention, various materials can be added for the purpose of coloring or electrostatic charge control. Such materials include, for example, carbon black, graphite, Nigrosine, metal complexes of monoazo dyes, ultramarine blue, and all sorts of lake pigments such as Phthalocyanine Blue, Hansa Yellow, Benzidine Yellow and Quinacridone.

Colloidal silica may also be contained in the toner particles as a fluidity improver in an amount of from 10 to 40% by weight. This fluidity improver may be mixed with the toner, in the instance of which it is added preferably in an amount of from 0.2 to 5% by weight based on the toner weight.

The toner used in the heat-fixing method of the present invention may preferably be a toner showing a maximum value of from 40° C. to 120° C., of the endothermic peak $T_D$ that first appears as a result of the measurement made within the measurement range of from 10° C. to 200° C. using a DSC. In particular, more preferred is a toner showing a characteristic of from 55° C. to 100° C.

The temperature at the time the film is peeled from the toner-fixed face may preferably be higher than the above endothermic temperature. More preferably, the film may be peeled under conditions of at least 30° C. higher, and more preferably be from 40° to 150° C. higher, than the above endothermic temperature.

Figure 3:
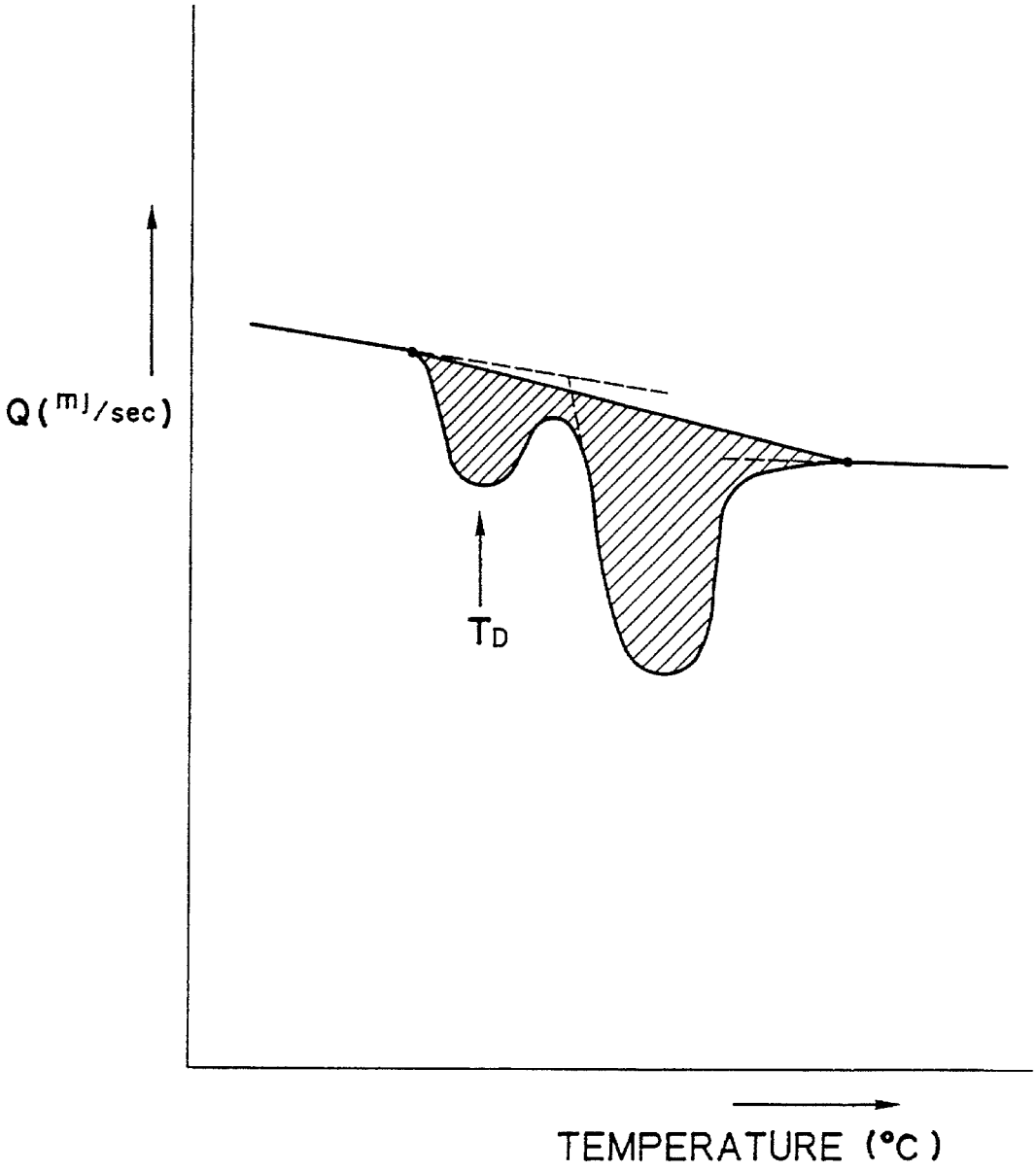
FIG. 3 is a graphic representation of an endothermic peak temperature $T_D$ of a toner, measured by differential thermal analysis (using DSC).

As for the method of measuring the maximum value of the endothermic peak as used in the present invention, the value can be calculated according to ASTM D-3418-82. Stated specifically, 10 to 15 mg of the toner is collected, which is then heated in a nitrogen atmosphere at a rate of temperature rise of 10° C./min from room temperature to 200° C., and thereafter the temperature is maintained at 200° C. for 10 minutes, followed by rapid cooling. The toner is thus pretreated. Thereafter, the temperature is maintained at 10° C. for 10 minutes, and the toner is again heated to 200° C. at a rate of temperature rise of 10° C./min, where the measurement is made. The data as shown in FIG. 3 can be commonly obtained, and the maximum value of the endothermic peak that first appears is defined as the endothermic temperature ($T_D$).

In the present invention, the heater element has a smaller heat capacity than conventional heat rolls, and has a linear heating part. The heating part may preferably be made to have a maximum temperature of from 100° to 300° C.

A film is interposed between the heater element and the pressure member, and may preferably comprise a heat-resistant sheet of from 1 to 100 μm in thickness. Heat-resistant sheets that can be used therefor include sheets of polymers having high heat-resistance, such as polyester, polyethylene terephthalate (PET), a tetrafluoroethylene/ perfluoroalkyl vinyl ether copolymer (PFA), polytetrafluoroethylene (PTFE), polyimide and polyamide, sheets of metals such as aluminum, and laminate sheets comprised of a metal sheet and a polymer sheet.

In a preferred constitution of the film, these heat-resistant sheets have a release layer and/or a low-resistance layer.

A preferred embodiment of the present invention will be described below with reference to the accompanying drawings.

Figure 4A:
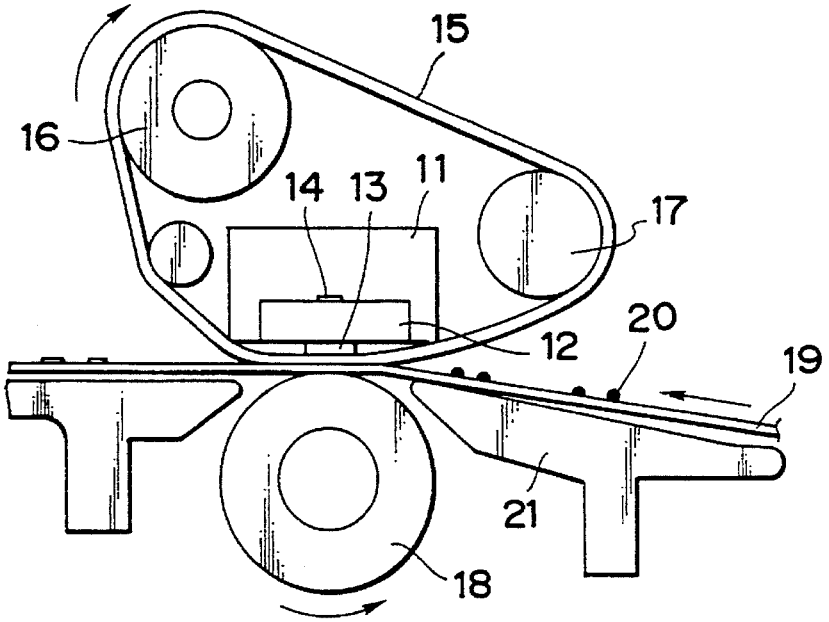
FIG. 4A is a schematic cross section of a fixing device used for carrying out the fixing method of the present invention.

FIG. 4A illustrates the structure of the fixing device in the present embodiment.

In FIG. 4A, the numeral 11 denotes a low heat capacitance linear heater element stationarily supported in the fixing device. An example thereof comprises an alumina substrate 12 of 1.0 mm in thickness, 10 mm in width and 240 mm in longitudinal length and a resistance material 13 coated thereon with a width of 1.0 mm, which is electrified from the both ends in the longitudinal direction. The electricity is applied under variations of pulse widths of the pulses corresponding with the desired temperatures and energy emission quantities which are controlled by a temperature sensor 14, in the pulse-like waveform with a period of 20 msec of DC 100 V. The pulse widths range approximately from 0.5 msec to 5 msec. In contact with the heater element 11 the energy and temperature of which have been controlled in this way, a fixing film 15 moves in the direction of the arrow shown in FIG. 4A. An example of this fixing film includes an endless film comprised of a heat-resistant sheet of 20 μm thick (comprising, for example, polyimide, polyetherimide, PES, or PFA) and a release layer (comprising a fluorine resin such as PTFE or PFA to which a conductive material is added) coated at least on the side coming into contact with images to have a thickness of 10 μm. In general, the total thickness of the film may preferably be not more than 100 μm, and more preferably less than 40 μm. The film is moved in the direction of the arrow in a wrinkle-free state by the action of the drive of, and tension between, a drive roller 16 and a follower roller 17.

The numeral 18 denotes a pressure roller having on its surface an elastic layer of rubber with good release properties as exemplified by silicone rubber. This pressure roller is pressed against the heater element at a total pressure of 4 to 20 kg through the film interposed between them and is rotated in pressure contact with the film. Toner 20 having not been fixed on a transferring medium 19 is led to the fixing zone by means of an inlet guide 21. A fixed image is thus obtained by the heating described above.

Figure 4B:
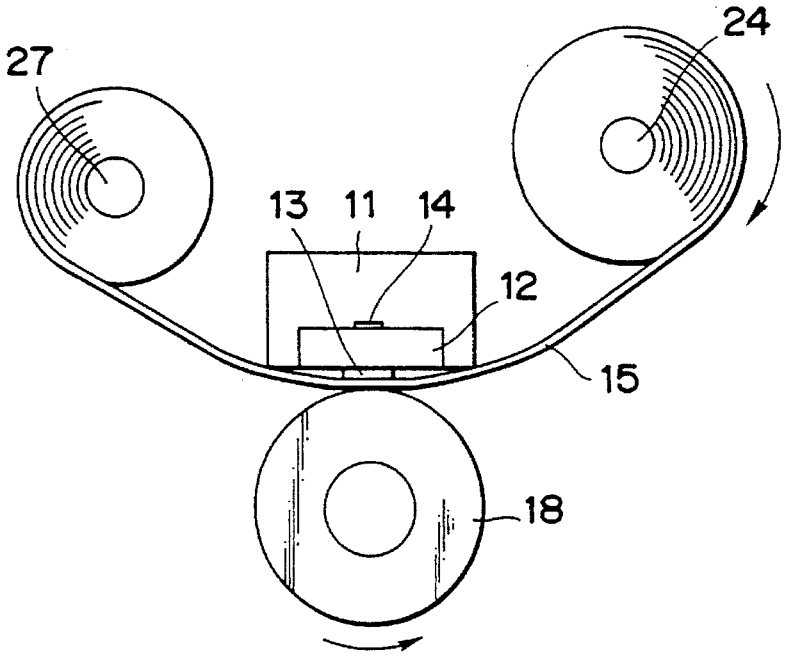
FIG. 4B is a schematic cross section of a fixing device used for carrying out the fixing method according to another embodiment of the present invention.

The above has been described with reference to the endless belt. As FIG. 4B shows, however, a sheet-feeding shaft 24 and a wind-up shaft 27 may also be used, where the fixing film may not be endless.

The image forming apparatus includes an apparatus that forms an image by the use of a toner, as exemplified by copying machines, printers, and facsimile apparatus, to which the present fixing device can be applied.

When the temperature detected by the temperature sensor 14 in the low heat capacitance linear heater element 11 is $T_1$, the surface temperature $T_2$ of the film 15 opposed to the resistance material 13 is substantially equal to $T_1$. The surface temperature $T_3$ of the film on the part at which the film 15 is peeled from the toner-fixed face is a temperature substantially equal to the above temperatures T1 and T2.

The present invention will be described below in greater detail by giving Examples and Comparative Examples which contain examples for preparing polyester resins used therein and examples for preparing toners that employ the resins as binder resins.

Examples of graft-modified polyolefins used in the examples of the present invention are shown in the following Table 1.

TABLE 1

| | Release agent (Graft-modified polyolefin) | | | | | | | |
|---|---|---|---|---|---|---|---|---|
| | | | Graft components | | | | | η (viscosity) |
| | Backbone polymer | | Aromatic vinyl monomer | | Unsaturate fatty acid (ester) | | | at 160° C. (cP) |
| 1 | Polyethylene | (100) | Styrene | (10) | 2-Ethylhexyl acrylate | (3) | | 11 |
| 2 | Polyethylene | (100) | Styrene | (5) | n-Butyl methacrylate | (15) | | 7 |
| 3 | Polyethylene | (100) | Styrene | (8) | Acrylic acid | (2) | | 8 |
| 4 | Polyethylene | (100) | Styrene | (20) | Butyl acrylate | (20) | | 27 |
| 5 | Polyethylene | (100) | Vinyltoluene | (14) | n-Butyl methacrylate | (14) | | 15 |
| 6 | Ethylene/polypropylene copolymer | (3/97) | Styrene | (10) | 2-Ethylhexyl acrylate | (4) | | 90 |
| 7 | Ethylene/polypropylene copolymer | (3/97) | Styrene | (9) | 2-Hydroxyethyl methacrylate | (6) | | 85 |
| 8 | Ethylene/polypropylene copolymer | (95/5) | Styrene | (17) | Butyl acrylate | (13) | | 17 |
| 9 | Ethylene/polypropylene copolymer | (95/5) | α-Methyl-styrene | (4) | Butyl acrylate | (6) | | 23 |
| 10 | Ethylene/polypropylene copolymer | (95/5) | Vinyltoluene | (11) | Diethyl itaconate | (13) | | 33 |
| 11 | Polypropylene | (100) | Styrene | (10) | 2-Ethylhexyl acrylate | (3) | | 110 |
| 12 | Polypropylene | (100) | Styrene | (5) | n-Butyl methacrylate | (15) | | 32 |
| 13 | Polypropylene | (100) | Styrene | (20) | Butyl acrylate | (20) | | 43 |
| 14 | Polypropylene | (100) | Styrene | (9) | Dimethylaminoethyl methacrylate | (1) | | 93 |

TABLE 1-continued

| Release agent (Graft-modified polyolefin) | | | | | | |
|---|---|---|---|---|---|---|
| | | Graft components | | | | η'(viscosity) |
| Backbone polymer | | Aromatic vinyl monomer | | Unsaturate fatty acid (ester) | | at 160° C. (cP) |
| Polypropylene | (100) | Vinyltoluene | (7) | Dodecyl methacrylate | (7) | 82 |

In ( ): Weight ratio

EXAMPLE 1

| | |
|---|---|
| Polyoxypropylene (2,2)-2,2-bis(4-hydroxyphenyl)propane | 22.0 parts by weight |
| Polyoxyethylene (2,2)-2,2-bis(4-hydroxyphenyl)propane | 32.5 parts by weight |
| Fumaric acid | 16.5 parts by weight |
| Terephthalic acid | 29 parts by weight |

The above materials in a total amount of 1,500 g were put into a 2 lit. volume four-necked round flask equipped with a thermometer, a stirrer made of stainless steel, a nitrogen-feeding tube made of glass, and a falling condenser. Subsequently, the flask was placed in a mantle heater, and nitrogen gas was fed from the feeding tube made of glass so that the inside of the reaction vessel was made to keep an inert atmosphere. Temperature was then raised. Thereafter, 0.10 g of dibutyltin oxide was added, the temperature was maintained at 210° C., and co-condensation reaction was carried out for 12 hours to give polyester resin A.

This polyester resin A showed an apparent viscosity $\eta a'$ at $t_a$=80° C. and an apparent viscosity $\eta b'$ at $t_b$=120° C. as measured by the overhead-type flow tester shown in FIG. 1, of $7.9\times10^5$ poise and $8.5\times10^2$ poise, respectively. The absolute value of the inclination of the natural logarithms $\ln\eta'$ of the melt viscosity with respect to the temperature was found to be 0.17 ln (poise)/°C.

Using a twin-screw kneader extruder, 100 parts by weight of the above polyester resin A, 6 parts by weight of a copper phthalocyanine pigment, 2 parts by weight of a negative charge control agent and 4 parts by weight of the graft-modified polyolefin No. 1 as shown in Table 1 were melt-kneaded. Thereafter, the kneaded product was cooled and then pulverized using an air-stream pulverizer, followed by classification using an air classifier to give a blue fine powder (a blue toner) with an average particle diameter of 12.5 μm. Based on 100 parts by weight of this blue fine powder, 0.6 part by weight of hydrophobic colloidal silica powder was added and mixed to give toner A having hydrophobic silica particles on the toner particle surfaces. This toner A showed $T_D$=56° C. Subsequently, based on 8 parts by weight of this toner A, 100 parts by weight of a coating ferrite carrier (coating agent: a fluorine-acrylate-styrene copolymer) was mixed to give developer A.

In the heat-fixing device of the present invention, as shown in FIG. 4A, the temperature sensor surface temperature $T_1$ of the heater element 11 was set to 110° C.; the power consumption of the resistance material at the heating part, 150 W; the total pressure between the heater element 11 and the pressure roller 18, 5 kg; the nip between the pressure roll and film, 3 mm; and the rotational speed of the fixing film 15, 50 mm/sec.

As the heat-resistant sheet, a polyimide film of 20 μm thick, having at the contact face with a recording medium a low-resistance release layer comprising a conductive material dispersed in PTFE was used. At this time, it took about 1 second until the temperature sensor surface temperature $T_1$ of the heater element reached 110° C. The temperature $T_2$ was 108° C., and the temperature $T_3$ was 107° C.

Evaluation was made in the following way: Using a modified machine obtained by detaching a fixing device from a commercially available copying machine NP-6650, manufactured by Canon Inc., the developer A was put in its developing device for color copying to carry out image production. Thus, an unfixed image of toner A was obtained. As a recording medium, commercially available 54 g/m$^2$ Canon New Dry Paper (available from Canon Sales, Co., Inc.) for use in copying machines was used. The resulting unfixed image of toner A was fixed using the above fixing device to give a fixed image.

For fixing performance tests on the fixed image, unfixed images on 200 sheets were successively papered through the fixing device to give fixed images, and the 1st, 10th, 50th, 100th and 200th sheets were each rubbed with Silbon paper under application of a load of 50 g/cm$^2$. The fixing performance was expressed by the rate (%) of a lowering of image density. For offset resistance tests, the entirely solid black unfixed images were successively fixed, and evaluation was made on how many sheets were papered until the fixed image or fixing film became stained.

As a result, the fixing performance was almost constant at the initial stage and the 200th sheet in 200 sheet papering, showing that it was as good as 0 to 1%. As to the offset resistance, almost no adhesion of toner on the surfaces of the fixing film 15 and pressure roller 18 was seen even after 20,000 sheet papering. The resulting fixed images were free from bleeding or bleed-through and were in good quality.

Comparative Example 1

A toner was prepared in the same manner as in Example 1 except that the release agent (the graft-modified polyolefin No. 1) of the toner A shown in Example 1 was replaced with a polyethylene not graft-modified ($\eta'$=10 cps at 160° C.), and evaluated in the same manner as in Example 1. As a result, the fixing performance was 2 to 5% at the initial stage and the 200th sheet in 200 sheet papering. Almost no adhesion of toner on the surfaces of the fixing film 15 and pressure roller 18 was seen after 10,000 sheet papering, but a little offset was seen on the fixing film 15 after 20,000 sheet papering.

EXAMPLE 2

Toner B prepared in the same manner as in Example 1 except that the graft-modified polyolefin No. 8 was used as the release agent in place of the graft-modified polyolefin No. 1 in the toner A was evaluated in the same manner as in Example 1. As a result, the fixing performance was almost constant at the initial stage and the 200th sheet in 200 sheet papering, showing that it was as good as 0 to 1%. As to the offset resistance, almost no adhesion of toner on the surfaces of the fixing film 15 and pressure roller 18 was seen even after 20,000 sheet papering. The resulting fixed images were free from bleeding or bleed-through and were in good quality.

EXAMPLE 3

| | |
|---|---|
| Polyoxypropylene (2,2)-2,2-bis(4-hydroxyphenyl)propane | 24.0 parts by weight |
| Polyoxyethylene (2,2)-2,2-bis(4-hydroxyphenyl)propane | 36.0 parts by weight |
| Fumaric acid | 40 parts by weight |

Polyester resin B was obtained in the same manner as the polyester resin A described in Example 1 except for using the above materials. This polyester resin B showed an apparent viscosity $\eta a'$ at $t_a$=80° C. and an apparent viscosity $\eta b'$ at $t_b$=120° C. as measured by the overhead-type flow tester shown in FIG. 1, of $4.0\times10^5$ poise and $2.2\times10^2$ poise, respectively. The absolute value of the inclination of the natural logarithms $\ln\eta'$ of the melt viscosity with respect to the temperature was found to be 0.19 ln (poise)/°C.

Toner C was obtained in the same manner as in Example 1 except that the polyester resin A was replaced with the polyester resin B, and the graft-modified polyolefin No. 9 was used as the release agent in place of the graft-modified polyolefin No. 1. The resulting toner C showed $T_D$=55° C.

Fixing performance tests and offset resistance tests were carried out in the same manner as in Example 1 except that the temperature sensor surface temperature $T_1$ of the heater element 11 was set to 150° C.; and the rotational speed of the fixing film 15, 150 mm/sec. As a result, the fixing performance was as good as 1 to 3%. As to the offset resistance, almost no adhesion of toner on the surfaces of the fixing film and pressure roller was seen even after 20,000 sheet papering.

The waiting time of the fixing device was about 1 second, which was the same as in Example 1. At this time, the temperature $T_2$ was 148° C. and the temperature $T_3$ was 146° C.

The resulting fixed images were free from bleeding or bleed-through and were in good quality.

EXAMPLE 4

| | |
|---|---|
| Polyester resin B | 100 parts by weight |
| Magnetic powder | 50 parts by weight |
| Negative charge control agent | 2 parts by weight |
| Graft-modified polyolefin No. 5 | 4 parts by weight |

Using a twin-screw kneader extruder, the above materials were melt-kneaded. Thereafter, the kneaded product was cooled and then pulverized using an air-stream pulverizer, followed by classification using an air classifier to give a black fine powder (a magnetic toner) with an average particle diameter of 12.0 μm. Based on 100 parts by weight of this magnetic toner, 0.4 part by weight of hydrophobic silica powder was added and mixed to give toner D having hydrophobic silica particles on the toner particle surfaces. This toner D showed $T_D$=57° C.

Using a modified machine obtained by detaching a fixing device from a commercially available copying machine NP-6650, manufactured by Canon Inc., the toner D was put in its developing device for black copying to carry out image production. Thus, an unfixed image of toner D was obtained. The unfixed image was fixed and the fixed image was evaluated under the same conditions as in Example 3. As a result, the fixing performance was as good as 2 to 4%. As to the offset resistance, almost no adhesion of toner on the surfaces of the fixing film and pressure roller was seen even after 20,000 sheet papering.

As described above, the present heat fixable toner and the heat fixing method that employs the toner can achieve good fixing of a toner image to a recording medium, does not cause the offset phenomenon on the fixing film, can be free from bleeding or bleed-through of toner into a recording medium to obtain a bleeding-free sharp image, and also can lower power consumption and make the waiting time very short.

Preparation example of polyester resin C:

| | |
|---|---|
| Polyoxypropylene (2,2)-2,2-bis(4-hydroxyphenyl)propane | 24.2 parts by weight |
| Polyoxyethylene (2,2)-2,2-bis(4-hydroxyphenyl)propane | 33.0 parts by weight |
| Terephthalic acid | 20.1 parts by weight |
| n-Dodecenylsuccinic acid | 9.7 parts by weight |
| Pyromellitic acid | 13.0 parts by weight |

The above materials in a total amount of 1,500 g were put into a 2 lit. volume four-necked round flask equipped with a thermometer, a stirrer made of stainless steel, a nitrogen-feeding tube made of glass, and a falling condenser. Subsequently, the flask was placed in a mantle heater, and nitrogen gas was fed from the feeding tube made of glass so that the inside of the reaction vessel was made to keep an inert atmosphere. Temperature was then raised. Thereafter, 0.10 g of dibutyltin oxide was added, the temperature was maintained at 210° C., and co-condensation reaction was carried out for 12 hours to give polyester resin C. This polyester resin C had an acid value of 12.0.

Preparation example of toner E:

Using a twin-screw kneader extruder, 100 parts by weight of the above polyester resin C, 60 parts by weight of magnetic powder (magnetic iron oxide), 1 part by weight of an organic metal complex (a chromium complex of 3,5-di-tert-butylsalicylic acid) and 4 parts by weight of the release agent No. 1 as shown in Table 1 were melt-kneaded (kneading temperature: 140° C.). Thereafter, the kneaded product was cooled and then pulverized using an air-stream pulverizer, followed by classification using an air classifier to give a magnetic toner with an average particle diameter of about 12 μm.

A product obtained by molding 15 g of the resulting magnetic toner by the use of a pressure molding device showed an apparent viscosity $\eta a'$ at $t_a$=120° C. and an apparent viscosity $\eta b'$ at $t_b$=150° C. as measured by the overhead-type flow tester shown in FIG. 1, of $1\times10^5$ poise and $6\times10^3$ poise, respectively. The absolute value of the inclination of the natural logarithms lnη' of this apparent viscosity with respect to the temperature was found to be 0.09 ln (poise)/°C.

Subsequently, based on 100 parts by weight of this magnetic toner, 0.4 part by weight of hydrophobic silica powder was added and mixed to give toner E having hydrophobic silica particles on the toner particle surfaces. This toner E showed $T_D$=65° C.

Preparation example of toner F:

Toner F was obtained in the same manner as the toner E except that the release agent No. 1 of the toner E was replaced with the release agent No. 6 shown in Table 1.

The toner F showed substantially the same melt viscosity characteristics as those of the toner E.

EXAMPLE 5

In the heat-fixing device of the present invention, as shown in FIG. 4A, the temperature sensor surface temperature $T_1$ of the heater element 11 was set to 220° C.; the power consumption of the resistance material at the heating part, 150 W; the total pressure between the heater element 11 and the pressure roller 18, 13 kg; the nip between the pressure roll and film, 3 mm; and the rotational speed of the fixing film 15, 120 mm/sec.

As the heat-resistant sheet, a polyimide film of 20 μm thick, having at the contact face with a recording medium a low-resistance release layer comprising a conductive material dispersed in PTFE was used. At this time, it took about 3 seconds until the temperature sensor surface temperature $T_1$ of the heater element reached 185° C. The temperature $T_2$ was 183° C., and the temperature $T_3$ was 182° C.

Evaluation was made in the following way: Using a modified machine obtained by detaching a fixing device from a commercially available copying machine NP-270RE, manufactured by Canon Inc., an unfixed image of toner E was obtained. As a recording medium, commercially available 54 g/m$^2$ Canon New Dry Paper (available from Canon Sales, Co., Inc.) for use in copying machines was used. The resulting unfixed image of toner E was fixed using the above fixing device to give a fixed image.

For fixing performance tests on the fixed image, unfixed images on 200 sheets were successively papered through the fixing device to give fixed images, and the 1st, 10th, 50th, 100th and 200th sheets were each rubbed with Silbon paper under application of a load of 50 g/cm$^2$. The fixing performance was expressed by the rate (%) of a lowering of image density. For offset resistance tests, the unfixed images were successively fixed, and evaluation was made on how many sheets were papered until the fixed image or fixing film became stained.

As a result, the fixing performance was almost constant at the initial stage and the 200th sheet in 200 sheet papering, showing that it was as good as 1 to 3%. As to the offset resistance, almost no adhesion of toner on the surfaces of the fixing film 15 and pressure roller 18 was seen even after 20,000 sheet papering. The resulting fixed images were free from bleeding or bleed-through and were in good quality.

EXAMPLE 6

Using the toner F, fixing performance tests were carried out in the same manner as in Example 5. As a result, like the toner E, the toner F showed superior fixing performance and offset resistance.

Preparation example of polyester resin D:

| | |
|---|---|
| Polyoxypropylene (2,2)-2,2-bis(4-hydroxyphenyl)propane | 29.5 parts by weight |
| Polyoxyethylene (2,2)-2,2-bis(4-hydroxyphenyl)propane | 34.5 parts by weight |
| Terephthalic acid | 22.0 parts by weight |
| n-Dodecenylsuccinic acid | 8.3 parts by weight |
| Pyromellitic acid | 5.7 parts by weight |

Polyester resin D was obtained in the same manner as the polyester resin C except for using the above materials. The resulting polyester resin D had an acid value of 21.5.

Preparation example of toner G:

Using a twin-screw kneader extruder, 100 parts by weight of the above polyester resin D, 4 parts by weight of the release agent No. 7 as shown in Table 1, 60 parts by weight of magnetic powder (magnetic iron oxide) and 0.5 part by weight of an organic metal compound (an acetylacetone iron) were melt-kneaded (kneading temperature: 140° C.). Thereafter, the kneaded product was cooled and then pulverized using an air-stream pulverizer, followed by classification using an air classifier to give a magnetic toner with an average particle diameter of about 12 μm.

A product obtained by molding 15 g of the resulting magnetic toner by the use of a pressure molding device showed an apparent viscosity ηa' at $t_a$=120° C. and an apparent viscosity ηb' at $t_b$=150° C. as measured by the overhead-type flow tester shown in FIG. 1, of 6.0×10$^4$ poise and 1.2×10$^3$ poise, respectively. The absolute value of the inclination of the natural logarithms lnη' of this apparent viscosity with respect to the temperature was found to be 0.13 ln (poise)/°C.

Subsequently, based on 100 parts by weight of this magnetic toner, 0.4 part by weight of hydrophobic silica powder was added and mixed to give toner G having hydrophobic silica particles on the toner particle surfaces. This toner G showed $T_D$=73° C.

Preparation example of toner H:

Toner H was obtained in the same manner as the toner G except that the release agent No. 7 of the toner G was replaced with the release agent No. 11 shown in Table 1.

EXAMPLE 7

Fixing performance tests and offset resistance tests were carried out using the toner G, in the same manner as in Example 5 except that the temperature sensor surface temperature $T_1$ of the heater element 11 was set to 190° C.; and the rotational speed of the fixing film 15, 150 mm/sec. As a result, the fixing performance was as good as 1 to 3%. As to the offset resistance also, good results were seen up to 20,000 sheet papering.

The waiting time of the fixing device was about 3 second, which was the same as in Example 5. At this time, the temperature $T_2$ was 188° C. and the temperature $T_3$ was 187° C.

The resulting fixed images were free from bleeding or bleed-through and were in good quality.

EXAMPLE 8

Using the toner H in place of the toner G, fixing performance tests were carried out in the same manner as in Example 7. As a result, like the toner G, the toner H showed superior fixing performance and offset resistance.

Preparation of comparative toner I:

In the same manner as in the case of the toner E, 100 parts by weight of the polyester resin C, 60 parts by weight of magnetic powder (magnetic iron oxide), 1 part by weight of an organic metal complex (a chromium complex of 3,5-di-tert-butylsalicylic acid) and 4 parts by weight of an unmodified polyethylene wax were melt-kneaded. The kneaded product was pulverized and then classified to give a comparative toner I. The comparative toner I had the same melt viscosity as the toner E.

Comparative Example 2

Fixing performance tests were carried out using the toner I in place of the toner E. As a result, the fixing performance was almost constant at the initial stage and the 200th sheet in 200 sheet papering, showing that it was 3 to 5%, which was a little poorer result than in the toner E (Example 5). As to the offset resistance, the same results were seen in 10,000 sheet papering, but adhesion of toner on the surfaces of the pressure roller and fixing film occurred after 20,000 sheet papering.

Preparation Example 1

| | |
|---|---|
| Polyoxypropylene (2,5)-2,2-bis(4-hydroxyphenyl)propane | 60 mol % |
| Fumaric acid | 40 mol % |

To the above materials, dibutyltin oxide was added in an amount of 0.05 mol % based on the total acid components. The system was kept at 210° C. While a stirring blade was rotated, the system was evacuated to 5 mmHg after 4 hours at the time when the effluence of the water in the system stopped. As a result, with the distillation of dialcohol components, the rotational load of the stirring blade gradually increased, and the load began to abruptly increase after 1.5 hours. Here the pressure inside the system was changed to 50 mmHg, so that the increase in stirring load became slow. This operation was repeated several times until the pressure inside the system came to be 300 mmHg, so that the distilling components came to be little produced. At this stage, the pressure inside the system was returned to ordinary pressure, and the stirring was continued for about 1 hour, followed by cooling to a room temperature to give linear polyester resin E having an acid value of 3.

Preparation Example 2

| | |
|---|---|
| Polyoxypropylene (2,5)-2,2-bis(4-hydroxyphenyl)propane | 35 mol % |
| Ethylene glycol | 20 mol % |
| Terephthalic acid | 25 mol % |
| Isophthalic acid | 20 mol % |

From the above monomers, linear polyester resin F having an acid value of 2 was obtained in the same manner as in Preparation Example 1.

Preparation Example 3

| | |
|---|---|
| Propylene glycol | 30 mol % |
| Ethylene glycol | 30 mol % |
| Terephthalic acid | 25 mol % |
| Triethylene dicarboxylic acid | 15 mol % |

From the above monomers, linear polyester resin G having an acid value of 3 was obtained in the same manner as in Preparation Example 1.

Preparation Example 4

Using the same monomers as in Preparation Example 1, linear polyester resin H having an acid value of 15 was obtained in the same manner as in Preparation Example 1 except that the pressure inside the system was not controlled.

Preparation Example 5

| | |
|---|---|
| Polyoxypropylene (2,5)-2,2-bis(4-hydroxyphenyl)propane | 45 mol % |
| Fumaric acid | 45 mol % |
| Trimellitic acid | 10 mol % |

From the above monomers, non-linear polyester resin I having an acid value of 35 was obtained in the same manner as in Preparation Example 4.

Preparation Example 6

| | |
|---|---|
| Polyoxypropylene (2,5)-2,2-bis(4-hydroxyphenyl)propane | 30 mol % |
| Polyoxyethylene (2,5)-2,2-bis(4-hydroxyphenyl)propane | 21 mol % |
| Terephthalic acid | 23 mol % |
| Succinic acid substituted with a $C_{12}$ alkyl group | 20 mol % |
| Trimellitic acid | 6 mol % |

From the above monomers, non-linear polyester resin J having an acid value of 40 was obtained in the same manner as in Preparation Example 4.

Preparation Example 7

| | |
|---|---|
| Polyoxypropylene (2,5)-2,2-bis(4-hydroxyphenyl)propane | 10 mol % |
| Polyoxyethylene (2,2)-2,2-bis(4-hydroxyphenyl)propane | 5 mol % |
| Triethylene glycol | 35 mol % |
| Terephthalic acid | 25 mol % |
| Isophthalic acid | 19 mol % |
| Trimellitic acid | 6 mol % |

From the above monomers, non-linear polyester resin K having an acid value of 40 was obtained in the same manner as in Preparation Example 4.

Preparation Example 8

The monomers used in Preparation Example 5 were polymerized by the method used in Preparation Example 1 to give non-linear polyester resin L having an acid value of 3.

Preparation Example 9

Non-linear polyester resin M was obtained in entirely the same manner as in Preparation Example 5 except that the reaction was stopped at the time when the acid value reached 70.

Fixing

A fixing unit of a copying machine FC-5, manufactured by Canon Inc., was taken out and so modified as to have a pressure between upper and lower rolls, of 0.30 kg/cm in linear pressure, a nip width of 3.0 mm, a linear velocity of 60 mm/sec, an upper roll temperature made variable between 100° C. and 270° C. Modified fixing device I was thus made ready for use. In the same way, modified fixing device II (pressure between upper and lower rolls: 2.5 kg/cm; nip width: 6.0 mm; linear velocity: 450 mm/sec; upper roll temperature: made variable between 100° C. and 270° C.) of a copying machine NP-7550, manufactured by Canon Inc., was also made ready for use. Fixing device III as shown in FIG. 4A was also made ready for use.

Development performance

Using a copying machine NP-4835, manufactured by Canon Inc., in the case of positively chargeable toner and a modified copying machine of NP-4835 in the case of negatively chargeable toner, a continuous 100,000 sheet copying test was carried out. In the case of non-magnetic toners, the ratio T/c, the ratio of a toner to a carrier, was set to be 8/100. The carrier used was comprised of a ferrite core coated with a styrene/methyl methacrylate/fluorine copolymer.

Blocking

Toners were left to stand for 3 days in an atmosphere of 50° C., and the state of blocking was visually observed.

EXAMPLE 9

| | |
|---|---|
| Polyester resin E | 70 parts* |
| Polyester resin I | 30 parts |
| Iron (II) acetylacetonate | 1 part |
| Magnetic material | 70 parts |
| Nigrosine dye | 2 parts |

*by weight (the same applies hereinafter)

In the above materials, 4 parts of a graft-modified polyolefin release agent W1 comprised of styrene and butyl acrylate used as graft components and having a number average molecular weight Mn of $5.3\times10^2$, a weight average molecular weight Mw of $8.0\times10^2$, an Mw/Mn of 1.5 and a melting point of 93° C. was mixed. The mixture was melt-kneaded using a twin-screw kneader extruder. Thereafter, the kneaded product was cooled and then pulverized, followed by classification to give a magnetic toner with a weight average particle diameter of 11 μm. Subsequently, 100 parts of this magnetic toner and 0.4 part of amino-modified silicone oil treated silica fine powder were mixed to give a positively chargeable magnetic toner.

The fixing performance was evaluated using the fixing device I. Fixing point was 125° C. High-temperature offset occurred at 200° C. or higher. The temperature region in which the fixing can be performed was 85° C. These were very superior results.

With regard to development performance, image density of from 1.35 to 1.38 was retained, and fog-free images were stably obtained. There was no problem in respect of blocking.

Examples 10 to 13, & Comparative Examples 3 to 5

Formulation of toners is summarized in Table 2, and results of evaluation, in Table 3.

As the graft-modified polyolefin release agent, a graft-modified polyethylene release agent W2 modified with styrene, butylene acrylate ($Mn=4.5\times10^2$, $Mw=5.9\times10^2$, Mw/Mn=1.3, melting point=80° C.) and a comparative polyethylene release agent W3 not graft-modified ($Mn=6.0\times10^2$, $Mw=1.4\times10^3$, Mw/Mn=2.3, melting point=118° C.) were used in addition to the release agent W1 used in Example 9.

In Comparative Example 6, a polyester resin O was used, which was obtained by adding 4 parts of chromium salicylate to 100 parts of the polyester resin K, which were melt-kneaded using a twin-screw kneader extruder, followed by cooling and pulverization.

TABLE 2

| | (1) | (2) | Organic metal compound | Magnetic material | Charge control agent | Release agent | Fluidity improver | (3) |
|---|---|---|---|---|---|---|---|---|
| | parts | | part(s)*1 | parts*1 | parts*1 | parts*1 | parts*2 | μm |
| Example: | | | | | | | | |
| 9 | E | I | Iron(II) acetylacetonate | Magnetite | Nigrosine dye | W1 | AMSO silica | 11.0 |
| | 70 | 30 | 1 | 70 | 2 | 4 | 0.4 | |
| 10 | F | J | Iron(II) acetylacetonate | Magnetite | Nigrosine dye | W2 | AMSO silica | 8.0 |
| | 80 | 20 | 1 | 80 | 2 | 4 | 0.6 | |
| 11 | G | K | Chromium salicylate | Magnetite | None | W2 | HPC silica | 10.5 |
| | 75 | 25 | 1 | 70 | | 4 | 0.5 | |

TABLE 2-continued

| | (1) | (2) parts | Organic metal compound part(s)*1 | Magnetic material parts*1 | Charge control agent parts*1 | Release agent parts*1 | Fluidity improver parts*2 | (3) μm |
|---|---|---|---|---|---|---|---|---|
| 12 | E 60 | J 40 | Iron(II) acetylacetonate 1.5 | None | Nigrosine dye 2 | W1 4 | AMSO silica 1.0 | 11.0 |
| 13 | F 70 | I 30 | Chromium salicylate 1 | None | None | W1 4 | HPC silica 0.5 | 8.0 |
| Comparative Example: | | | | | | | | |
| 3 | H 80 | J 20 | Iron(II) acetylacetonate 1 | Magnetite 80 | Nigrosine dye 2 | W2 4 | AMSO silica 0.6 | 8.0 |
| 4 | E 70 | L 30 | Iron(II) acetylacetonate 1 | Magnetite 70 | Nigrosine dye 2 | W1 4 | AMSO silica 0.4 | 11.0 |
| 5 | E 60 | J 40 | Iron(II) acetylacetonate 1.5 | None | Nigrosine dye 2 | W3 4 | AMSO silica 1.0 | 11.0 |

(1): Linear polyester resin,
(2): Non-linear polyester resin
(3): Average particle diameter of toner
AMSO silica: Amino-modified silicone oil treated silica
HPC silica: Hydrophobic colloidal silica
*1: based on 100 parts of binder resin
*2: based on 100 parts of toner

TABLE 3

| | (1) | Fixing point °C. | (2) °C. | (3) °C. | Developing performance, density/fog | Blocking |
|---|---|---|---|---|---|---|
| Example: | | | | | | |
| 9 | I | 125 | 200 | 75 | 1.35 to 1.38* | None |
| 10 | II | 140 | 235 | 95 | 1.35 to 1.38* | None |
| 11 | III | 120 | 220 | 100 | 1.34 to 1.36* | None |
| 12 | I | 120 | 210 | 90 | 1.35 to 1.38* | None |
| 13 | III | 125 | 205 | 80 | 1.34 to 1.36* | None |
| Comparative Example: | | | | | | |
| 3 | II | 160 | 205 | 45 | 1.35 to 1.38* | None |
| 4 | I | 120 | 160 | 40 | 1.35 to 1.38* | None |
| 5 | I | 135 | 205 | 70 | 1.35 to 1.38* | Occurred |

(1): Fixing device used in evaluation
(2): Temperature at which high-temperature offset occurred
(3): Fixable temperature region
*No fog occurred.

As having been described above, the toner of the present invention can provide an image having a superior low-temperature fixing performance and a high quality. In addition, it can promise a high production efficiency, and can be stably supplied.

We claim:

1. A heat fixable toner comprising a binder resin and a graft-modified polyolefin as a release agent, wherein said binder resin comprises a bisphenolic polyester resin, said polyester resin being obtained by co-condensation of an acid component containing aromatic dicarboxylic acids in amounts of at least 30 mole % based on the total of said acid component and an alcohol component containing etherified bisphenols in amounts of at least 80 mole % based on the total of said alcohol component and having the properties that the melt viscosity $\eta'$ measured with an overhead flow tester is from $10^3$ to $10^6$ poise at a temperature within the temperature range of from 80° C. to 120° C. and an absolute value of the inclination of a graph is not more than 0.50 ln (poise)/°C. when the natural logarithms $\ln\eta'$ of the melt viscosity at 80° C. and 120° C. are plotted with respect to the temperatures; and said graft-modified polyolefin comprises an α-olefin polymer graft-modified with a grafting agent of from 0.1 to 100 parts by weight based on 100 parts by weight of the α-olefin polymer, wherein said grafting agent comprises from 20 to 80% by weight of a styrenic monomer and from 80 to 20% by weight of at least one monomer selected from the group consisting of methacrylic monomer, acrylic monomer, maleic monomer, fumaric monomer, itaconic monomer and citraconic monomer.

2. A heat fixable toner according to claim 1, wherein said binder resin comprises a mixture of a linear polyester resin having an acid value of less than 5 mg.KOH/g and a non-linear polyester resin having an acid value of from 5 to 60 mg.KOH/g, and said graft-modified polyolefin comprises a graft-modified polyolefin having a low melting point.

3. A heat fixable toner according to claim 2, wherein said graft-modified polyolefin has a melting point of from 60° to 120° C.

4. A heat fixable toner according to claim 2, wherein said graft-modified polyolefin has a melting point of from 60° to 100° C.

5. A heat fixable toner according to claim 1, wherein:

said bisphenolic polyester resin comprises a polyester resin obtained by co-condensation polymerization of an etherified bisphenol with a carboxylic acid or its derivative, including a carboxylic acid with two or more carboxylic groups, an anhydride thereof or a lower alkyl ester thereof and;

said graft-modified polyolefin has a melt viscosity of from 1 to 250 cps (centipoise) at 160° C. and is contained in an amount of from 0.1 to 20% by weight based on the weight of the binder resin.

6. A heat fixable toner according to claim 1, including a coloring agent and wherein:

said bisphenolic polyester resin comprises a polyester resin having an acid value of from 5 to 60, formed of:

(A) an etherified bisphenol;

(B) not less than 30 mol % of an aromatic dicarboxylic acid, in all acid components;

(C) 5 to 40% by weight of an alkenyl-substituted dicarboxylic acid, an alkyl-substituted dicarboxylic acid or mixtures thereof, based on the total amount of acids; and (D) a polycarboxylic acid with three or more carboxylic groups, a polyol with three or more hydroxy groups, or mixtures thereof;

an organic metal compound comprising a metal of valence of two or more is present in an amount of from 0.2 to 6% by weight based on the weight of the binder resin;

said graft-modified polyolefin has a melt viscosity of from 1 to 250 cps (centipoise) at 160° C. and is present in an amount of from 0.1 to 20% by weight based on the weight of the binder resin; and said toner has a melt viscosity η' measured with an overhead flow tester from $10^3$ to $10^6$ poise at a temperature within the temperature range of from 120° C. to 150° C., and an absolute value of the inclination of a graph is not more than 0.50 ln (poise)/°C. when the natural logarithms lnη' of the melt viscosity at 120° C. and 150° C. are plotted with respect to the temperatures.

7. A heat fixable toner according to claim 1, wherein;

said binder resin contains a linear polyester resin having an acid value of less than 5 mg.KOH/g and a non-linear polyester resin having an acid value of from 5 to 60 mg.KOH/g, and contains an organic metal compound of a valence of two or more in an amount of from 0.2 to 10 parts by weight based on 100 parts by weight of the binder resin; and said graft-modified polyolefin comprises a low-melting graft-modified polyolefin having a number average molecular weight Mn of not more than $1.0\times10^3$, a weight average molecular weight Mw of not more than $2.5\times10^3$, an Mw/Mn of not more than 3.0, and a melting point of from 60° to 120° C.

8. A heat fixable toner according to claim 1, wherein a grafting agent is used in an amount of from 1 to 50 parts by weight based on 100 parts by weight of the α-olefin monomer, to graft-modify said α-olefin polymer.

9. A heat fixable toner according to claim 1, wherein said styrenic monomer comprises a monomer selected from the group consisting of styrene, o-methylstyrene, m-methylstyrene, p-methylstyrene, α-methylstyrene, 2,4-dimethylstyrene, p-ethylstyrene, p-n-butylstyrene, p-tert-butylstyrene, p-n-dodecylstyrene, p-phenylstyrene and p-chlorostyrene.

10. A heat fixable toner according to claim 1, wherein said methacrylic monomer comprises a monomer selected from the group consisting of methyl methacrylate, ethyl methacrylate, propyl methacrylate, n-butyl methacrylate, isobutyl methacrylate, n-octyl methacrylate, 2-ethylhexyl methacrylate, lauryl methacrylate, stearyl methacrylate, dodecyl methacrylate, phenyl methacrylate, dimethylaminoethyl methacrylate, diethylaminoethyl methacrylate, 2-hydroxyethyl methacrylate, 2,2,2-trifluoroethyl methacrylate, and glycidyl methacrylate.

11. A heat fixable toner according to claim 1, wherein said methacrylic monomer comprises a monomer selected from the group consisting of methyl acrylate, ethyl acrylate, propyl acrylate, n-butyl acrylate, isobutyl acrylate, n-octyl acrylate, lauryl acrylate, stearyl acrylate, dodecyl acrylate, 2-ethylhexyl acrylate, phenyl acrylate, 2-chloroethyl acrylate, 2-hydroxyethyl acrylate, cyclohexyl acrylate, dimethylaminoethyl acrylate, diethylaminoethyl acrylate, dibutylaminoethyl acrylate, 2-ethoxy acrylate and 1,4-butanediol diacrylate.

12. A heat fixable toner according to claim 1, wherein said maleic monomer comprises a monomer selected from the group consisting of maleic acid, monoethyl maleate, diethyl maleate, monopropyl maleate, dipropyl maleate, monobutyl maleate, dibutyl maleate and di-2-ethylhexyl maleate.

13. A heat fixable toner according to claim 1, wherein said fumaric monomer comprises a monomer selected from the group consisting of fumaric acid, monoethyl fumarate, diethyl fumarate, dibutyl fumarate and di-2-ethylhexyl fumarate.

14. A heat fixable toner according to claim 1, wherein said itaconic monomer comprises a monomer selected from the group consisting of itaconic acid, monoethyl itaconate and diethyl itaconate.

15. A heat fixable toner according to claim 1, wherein said citraconic monomer comprises a monomer selected from the group consisting of citraconic acid, monoethyl citraconate and diethyl citraconate.

16. A heat fixable toner according to claim 1, wherein said α-olefin polymer comprises a member selected from the group consisting of homopolymer of α-olefins, copolymer of two or more kinds of α-olefins and an oxide thereof.

17. A heat fixable toner according to claim 16, wherein said α-olefin comprises a member selected from the group consisting of ethylene, propylene, 1-butene, 1-hexane, 1-decene, and 4-methyl-1-pentene.

18. A heat fixable toner comprising a binder resin and a graft-modified polyolefin as a release agent, wherein said binder resin comprises a bisphenolic polyester resin, said polyester resin being obtained by co-condensation of an acid component containing aromatic dicarboxylic acids in amounts of at least 30 mol % based on the total of said acid component and an alcohol component containing etherified bisphenols in amounts of at least 80 mol % based on the total of said alcohol component; and said graft-modified polyolefin comprises an α-olefin polymer graft-modified with a grafting agent of from 0.1 to 100 parts by weight based on 100 parts by weight of the α-olefin polymer, wherein said grafting agent comprises from 20 to 80% by weight of an styrenic monomer and from 80 to 20% by weight of at least one monomer selected from the group consisting of methacrylic monomer, acrylic monomer, maleic monomer, fumaric monomer, itaconic monomer and citraconic monomer.

19. A heat fixable toner according to claim 18, wherein said toner has a melt viscosity η' measured with an overhead flow tester from $10^3$ to $10^6$ poise at a temperature within the temperature range of from 120° C. to 150° C., and an absolute value of the inclination of a graph is not more than 0.50 ln (poise)/°C. when the natural logarithms lnη' of the melt viscosity at 120° C. and 150° C. are plotted with respect to the temperatures.

20. A heat fixable toner according to claim 18, wherein said toner has a melt viscosity of from 1 to 250 centipoise at 160° C.

21. A heat fixable toner according to claim 18, wherein said graft-modified polyolefin is present in said toner in an amount of from 0.1 to 20% by weight based on the weight of the binder resin.

22. A heat fixable toner according to claim 18, wherein said graft-modified polyolefin is present in said toner in an amount of from 0.5 to 10% by weight based on the weight of the binder resin.

23. A heat fixable toner according to claim 18, wherein a grafting agent is used in an amount of from 1 to 50 parts by weight based on 100 parts by weight of the α-olefin monomer to graft-modify said α-olefin polymer.

24. A heat fixable toner according to claim 18, wherein said styrenic monomer comprises a monomer selected from the group consisting of styrene, o-methylstyrene, m-methylstyrene, p-methylstyrene, α-methylstyrene, 2,4-dimethylstyrene, p-ethylstyrene, p-n-butylstyrene, p-tert-butylstyrene, p-n-dodecylstyrene, p-phenylstyrene and p-chlorostyrene.

25. A heat fixable toner according to claim 18, wherein said methacrylic monomer comprises a monomer selected from the group consisting of methyl methacrylate, ethyl methacrylate, propyl methacrylate, n-butyl methacrylate, isobutyl methacrylate, n-octyl methacrylate, 2-ethylhexyl methacrylate, lauryl methacrylate, stearyl methacrylate, dodecyl methacrylate, phenyl methacrylate, dimethylaminoethyl methacrylate, diethylaminoethyl methacrylate, 2-hydroxyethyl methacrylate, 2,2,2-trifluoroethyl methacrylate, and glycidyl methacrylate.

26. A heat fixable toner according to claim 18, wherein said methacrylic monomer comprises a monomer selected from the group consisting of methyl acrylate, ethyl acrylate, propyl acrylate, n-butyl acrylate, isobutyl acrylate, n-octyl acrylate, lauryl acrylate, stearyl acrylate, dodecyl acrylate, 2-ethylhexyl acrylate, phenyl acrylate, 2-chloroethyl acrylate, 2-hydroxyethyl acrylate, cyclohexyl acrylate, dimethylaminoethyl acrylate, diethylaminoethyl acrylate, dibutylaminoethyl acrylate, 2-ethoxy acrylate and 1,4-butanediol diacrylate.

27. A heat fixable toner according to claim 18, wherein said maleic monomer comprises a monomer selected from the group consisting of maleic acid, monoethyl maleate, diethyl maleate, monopropyl maleate, dipropyl maleate, monobutyl maleate, dibutyl maleate and di-2-ethylhexyl maleate.

28. A heat fixable toner according to claim 18, wherein said fumaric monomer comprises a monomer selected from the group consisting of fumaric acid, monoethyl fumarate, diethyl fumarate, dibutyl fumarate and di-2-ethylhexyl fumarate.

29. A heat fixable toner according to claim 18, wherein said itaconic monomer comprises a monomer selected from the group consisting of itaconic acid, monoethyl itaconate and diethyl itaconate.

30. A heat fixable toner according to claim 18, wherein said citraconic monomer comprises a monomer selected from the group consisting of citraconic acid, monoethyl citraconate and diethyl citraconate.

31. A heat fixable toner according to claim 18, wherein said α-olefin polymer comprises a member selected from the group consisting of homopolymer of α-olefins, copolymer of two or more kinds of α-olefins and an oxide thereof.

32. A heat fixable toner according to claim 31, wherein said α-olefin comprises a member selected from the group consisting of ethylene, propylene, 1-butene, 1-hexane, 1-decene, and 4-methyl-1-pentene.

33. A heat fixable toner according to claim 18, including a coloring agent and wherein:

said bisphenolic polyester resin comprises a polyester resin having an acid value of from 5 to 60, formed of:

(A) an etherified bisphenol;

(B) not less than 30 mol % of an aromatic dicarboxylic acid, in all acid components;

(C) 5 to 40% by weight of an alkenyl-substituted dicarboxylic acid, an alkyl-substituted dicarboxylic acid or mixtures thereof, based on the total amount of acids; and (D) a polycarboxylic acid with three or more carboxylic groups, a polyol with three or more hydroxy groups, or mixtures thereof;

an organic metal compound comprising a metal of valence of two or more is present in an amount of from 0.2 to 6% by weight based on the weight of the binder resin;

said graft-modified polyolefin has a melt viscosity of from 1 to 250 centipoise at 160° C. and is present in an amount of from 0.1 to 20% by weight based on the weight of the binder resin; and said toner has a melt viscosity $\eta'$ measured with an overhead flow tester from $10^3$ to $10^6$ poise at a temperature within the temperature range of from 120° C. to 150° C., and an absolute value of the inclination of a graph is not more than 0.50 ln (poise)/°C. when the natural logarithms $\ln\eta'$ of the melt viscosity at 120° C. and 150° C. are plotted with respect to the temperatures.

* * * * *

UNITED STATES PATENT AND TRADEMARK OFFICE

CERTIFICATE OF CORRECTION

PATENT NO. : 5,478,686

DATED : December 26, 1995

INVENTOR(S) : HIROAKI KAWAKAMI ET AL.

It is certified that error appears in the above-identified patent and that said Letters Patent is hereby corrected as shown below:

COLUMN 1

Line 9, "invention" should read --Invention--.

COLUMN 2

Line 64, "toner" should read --toner,--.

COLUMN 3

Line 45, "direct touch to" should read --directly touching--.

COLUMN 5

Line 26, "tb°C." should read --$t_b$°C.--.

Line 31, "$\tan\theta = \frac{\ln\theta a' - \ln\eta b'}{t_b - t_a}$" should read --$\tan\theta = \frac{\ln\eta a' - \ln\eta b'}{t_b - t_a}$--.

UNITED STATES PATENT AND TRADEMARK OFFICE

CERTIFICATE OF CORRECTION

PATENT NO. : 5,478,686

DATED : December 26, 1995

INVENTOR(S) : HIROAKI KAWAKAMI ET AL.

It is certified that error appears in the above-identified patent and that said Letters Patent is hereby corrected as shown below:

COLUMN 6

Line 36, "of;" should read --of:--.

COLUMN 7

Line 56, "concurrence" should read --occurrence--.

COLUMN 8

Line 17, "of of" should read --of--.

COLUMN 10

Line 35, "conditions. Condition" should read --conditions. ¶ Condition--.
Line 65, "glutalic" should read --glutaric--.

COLUMN 12

Line 24, "azobisisobutylonitrile," should read --azobisisobutyronitrile,--.

UNITED STATES PATENT AND TRADEMARK OFFICE

CERTIFICATE OF CORRECTION

PATENT NO. : 5,478,686

DATED : December 26, 1995

INVENTOR(S) : HIROAKI KAWAKAMI ET AL.

It is certified that error appears in the above-identified patent and that said Letters Patent is hereby corrected as shown below:

COLUMN 13

Line 36, "least;" should read --least:--.
Line 64, "resin;" should read --resin.--.

COLUMN 16

Table 1, "$\eta^{(vis-}$" should read --$\eta$(vis- -- and
"Unsaturate" should read --Unsaturated--.

COLUMN 17

Table 1-continued,
"Unsaturate" should read --Unsaturated--.

COLUMN 22

Line 55, "3 second," should read --3 seconds,--.

COLUMN 28

Line 55, "thereof and;" should read --thereof; and--.

COLUMN 29

Line 13, "250 cps (centipoise)" should read
--250 centipoise--.
Line 24, "wherein;" should read -wherein:--.

UNITED STATES PATENT AND TRADEMARK OFFICE

CERTIFICATE OF CORRECTION

PATENT NO. : 5,478,686

DATED : December 26, 1995

INVENTOR(S) : HIROAKI KAWAKAMI ET AL.

It is certified that error appears in the above-identified patent and that said Letters Patent is hereby corrected as shown below:

COLUMN 30

Line 49, "an" should read --a--.

Signed and Sealed this

Fourth Day of June, 1996

Bruce Lehman

*Attest:*

BRUCE LEHMAN

*Attesting Officer*

*Commissioner of Patents and Trademarks*